US007693477B2

(12) United States Patent
Chatani et al.

(10) Patent No.: US 7,693,477 B2
(45) Date of Patent: Apr. 6, 2010

(54) IMAGE FORMING MEMBER, TONER REMOVING APPARATUS, DEVELOPING APPARATUS, AND IMAGE FORMING APPARATUS

(75) Inventors: Kiyoshi Chatani, Kanagawa (JP); Kei Hirata, Kanagawa (JP); Takashi Sakamoto, Kanagawa (JP); Hideaki Miyata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 207 days.

(21) Appl. No.: 11/785,169

(22) Filed: Apr. 16, 2007

(65) Prior Publication Data

US 2008/0056771 A1 Mar. 6, 2008

(30) Foreign Application Priority Data

Aug. 31, 2006 (JP) ..... P2006-236698

(51) Int. Cl.
*G03G 21/00* (2006.01)

(52) U.S. Cl. ..... 399/358; 399/359

(58) Field of Classification Search ..... 399/25, 399/358, 359, 253

See application file for complete search history.

(56) References Cited

U.S. PATENT DOCUMENTS

| | | | | |
|---|---|---|---|---|
| 5,499,090 | A * | 3/1996 | Ito et al. | 399/359 |
| 2004/0253022 | A1* | 12/2004 | Arai et al. | 399/253 |
| 2005/0019070 | A1* | 1/2005 | Suda et al. | 399/346 |

FOREIGN PATENT DOCUMENTS

| | | | |
|---|---|---|---|
| JP | 59-091461 | | 5/1984 |
| JP | 62-067572 | | 3/1987 |
| JP | 05-204239 | | 8/1993 |
| JP | 06-308828 | | 11/1994 |
| JP | 08-123182 | | 5/1996 |
| JP | 08-123276 | | 5/1996 |
| JP | 10-293461 | | 11/1998 |
| JP | 11-327393 | | 11/1999 |
| JP | 2000-335762 | | 12/2000 |
| JP | 2001-22181 | | 1/2001 |
| JP | 2002-311768 | | 10/2002 |
| JP | 2004-102319 | | 4/2004 |
| JP | 2004-177754 | * | 6/2004 |

* cited by examiner

*Primary Examiner*—David M Gray
*Assistant Examiner*—Barnabas T Fekete
(74) *Attorney, Agent, or Firm*—Morgan, Lewis & Bockius LLP

(57) ABSTRACT

An image forming member includes: an electrostatic latent image holding member that holds an electrostatic latent image; a developing unit that develops a toner image formed by a toner on a surface of the electrostatic latent image holding member; a toner removing member that removes a residual toner remaining on a surface of the electrostatic latent image holding member; a conveying path including a conveying member that is internally provided in the conveying path and that returns the residual toner removed from the surface of the electrostatic latent image holding member to the developing unit; and a trapping portion that traps a foreign matter conveyed by the conveying member, the electrostatic latent image holding member, the developing unit, the toner removing member, the conveying path, and the trapping portion of the image forming member being integrally and detachably attached to an image forming apparatus body.

8 Claims, 20 Drawing Sheets

IMAGE FORMING MEMBER, TONER REMOVING APPARATUS, DEVELOPING APPARATUS, AND IMAGE FORMING APPARATUS

CROSS-REFERENCE TO RELATED APPLICATIONS

This application is based on and claims priority under 35 U.S.C. 119 from Japanese Patent Application No. 2006-236698 filed Aug. 31, 2006.

BACKGROUND

1. Technical Field

The present invention relates to an image forming member, to a toner removing apparatus, to a developing apparatus, and to an image forming apparatus.

2. Related Art

There is an art such as a recycled developer classification apparatus that collects, after performing an image forming process, residual developers, that classifies the collected developers into those to be reused, and those to be discarded, and that has a classification portion including filter means which classifies the collected developers into those to be reused, and those to be discarded.

The classification apparatus serves as a filtering means configured so that a cylindrical mesh of a toner classification unit fitted into a pipe communicating with a path used to convey toner, which is not transferred to transfer paper, to the toner classification unit is rotationally driven to rotate thereby to separate foreign matters from developers.

There is an art such as an electrophotographic apparatus which comprises a developing unit configured to accommodate a two-component developer including toner and carrier and to develop an electrostatic latent image with a developer, and also comprises a toner recycling mechanism to thereby form images and recycle the toner. The developing unit of this electrophotographic apparatus has a mesh member provided in a developer flow path, and also has a rubbing member configured to rub against the mesh member. Thus, paper powder in recycled toner is positively rubbed against the mesh member to thereby crush the paper powder into small particles. Simultaneously, the meshes of the mesh member are prevented from being clogged.

SUMMARY

According to an aspect of the present invention, an image forming member comprising: an electrostatic latent image holding member that holds an electrostatic latent image; a developing unit that develops a toner image formed by a toner on a surface of the electrostatic latent image holding member; a toner removing member that removes a residual toner remaining on a surface of the electrostatic latent image holding member; a conveying path including a conveying member that is internally provided in the conveying path and that returns the residual toner removed from the surface of the electrostatic latent image holding member to the developing unit; and a trapping portion that traps a foreign matter conveyed by the conveying member, the electrostatic latent image holding member, the developing unit, the toner removing member, the conveying path, and the trapping portion of the image forming member being integrally and detachably attached to an image forming apparatus body.

BRIEF DESCRIPTION OF THE DRAWINGS

Exemplary embodiment of the present invention will be described in detail based on the following figures, wherein.

DETAILED DESCRIPTION

First, an outline of an embodiment model, to which the invention is applied, is described below.

Outline of Embodiment Model

Figure 1A:
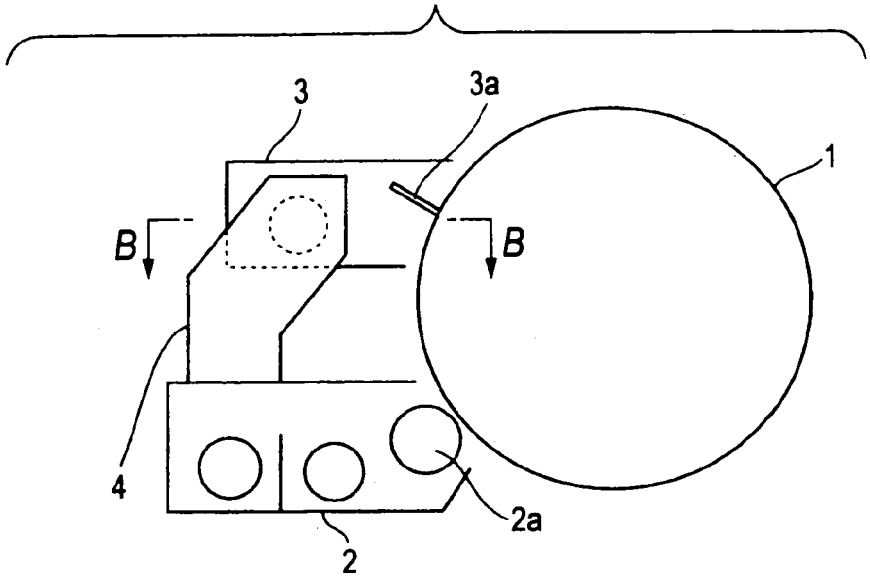
FIG. 1A is an explanatory view illustrating an outline of a mode for implementing an image forming apparatus according to the invention.
Figure 1B:
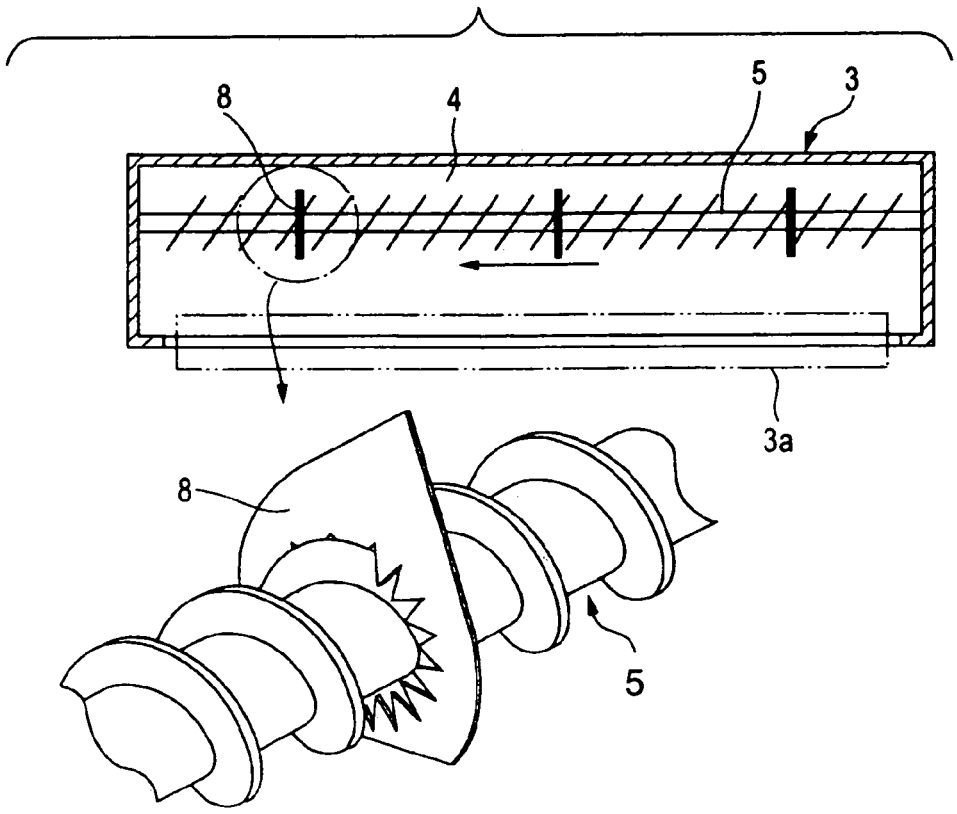
FIG. 1B is a cross-sectional view taken along line B-B shown in FIG. 1A.

FIG. 1A is an explanatory view schematically an image forming apparatus according to an embodiment model implementing the invention. FIG. 1B is an explanatory cross-sectional view taken on line B-B shown in FIG. 1A.

The image forming apparatus shown in these figures visualizes an electrostatic latent image, using toner. The image forming apparatus includes an electrostatic latent image holding member 1, for example, a photoreceptor drum capable of holding an electrostatic latent image, and also includes a developing unit 2 that has a developing member 2*a*, for example, a magnetic roll facing the electrostatic latent image holding member 1 and that uses toner supplied to the developing member 2*a* to visualize an electrostatic latent image. The image forming apparatus also includes a toner removing unit 3 that has a toner removing member 3*a*, for example, a cleaning blade adapted to remove toner remaining on the electrostatic latent image holding member 1, and that collects toner removed by the toner removing member 3*a*, and a conveying path 4 used to return the toner collected by the toner removing unit 3 to the developing unit 2.

In this embodiment model, a rotary conveying member having a rotating shaft and a spiral blade formed around the rotating shaft, which is an example of a conveying member 5 for conveying toner, is disposed in all or a part of the conveying path 4. A trapping portion 8 configured to trap a foreign matter by simultaneously suppressing the foreign matter from moving in a toner conveying direction, in which toner is conveyed by the conveying member 5, and also simultaneously allowing the toner to pass therethrough, is provided between the conveying member 5 and the conveying path 4.

In such a technical means, the developing method employed by the developing unit 2 includes not only a two-component developing method but a single-component developing method. The layout of the developing unit 2 and the toner removing unit 3 is optional. However, from the viewpoint of returning toner to an upper position and then effectively utilizing the free fall of the toner due to the force of gravity, preferably, the toner removing unit 3 is disposed above the developing unit 2. It is optional to provide the conveying path 4, through which toner is conveyed between the toner removing unit 3 and the developing unit 2, and to also provide the conveying member 5, which conveys toner, in the conveying path 4. Although a path simply utilizing the free fall due to the force of gravity may be employed as the conveying path 4 between the toner removing unit 3 and the developing unit 2, preferably, the conveying member 5 is provided in a mode, in which the conveying path 4 has, for example, a first component, to assure toner conveyability. For instance, a conveying member having a plate-like blade is used as an example of such a kind of the conveying member 5.

Additionally, the electrostatic latent image holding member 1, the developing unit 2, the toner removing unit 3, and the conveying path 4 between the developing unit 2 and the toner removing unit 3 may be separated from and independent of one another. However, in consideration of the replacement workability of components and a toner spill in an image forming apparatus, the present embodiment model employs a process cartridge integrally including these elements. In consideration of the maintenance of the members, the exchange time thereof, the cleaning of foreign matters trapped by the trapping member, and the replacement of the trapping member, the process cartridge may be set in a mode in which the process cartridge can be divided into the members after detached from the image forming apparatus. Alternatively, the process cartridge may be set in a mode in which both of the detachment of each of the members and the integral detachment of the members are possible.

A rotary conveying member having a rotating shaft and a spiral blade formed therearound and a conveying member equipped with a plate-like-blade are described in the description of the present embodiment model as the conveying member 5. However, the conveying member according to the invention is not limited thereto. As long as conveying toner in a predetermined direction, any conveying member may be included. For example, a conveying member may be employed, which conveys toner by forming and rotating spiral wire-like members around a rotating shaft.

It is sufficient that the trapping portion 8 traps foreign matters, for example, fibrous dusts between the inner wall surface of the conveying path 4 and the conveying member 5 provided in the conveying path 4. For example, it is sufficient that the trapping portion 8 suppresses foreign matters from moving in a direction in which toner is conveyed by the conveying member 5.

In the description of the present embodiment model, the trapping portion 8, which extends from the inner wall surface of the conveying path 4 toward the conveying member 5 and is formed of a flexible member, is described as an example. However, the trapping portion according to the invention is not limited thereto. A trapping member extending from the conveying member 5 to the inner wall surface of the conveying path 4 may be used. In a case where the conveying member 5 has a rotating shaft and a conveying portion disposed around the rotating shaft, the trapping portion 8 may be provided either on the rotating shaft or in the conveying portion. Additionally, foreign matters may be trapped by providing the trapping portion either on the rotating shaft or in the conveying portion.

Additionally, the trapping portion 8 may be disposed at a place, at which the conveying member 5 is disposed, in the conveying path 4 which may be any of that 4 provided in the toner removing unit 3, that 4 provided in the developing unit 2, and that 4 provided between the toner removing unit 3 and the developing unit 2. Alternatively, the trapping portion 8 may be provided at each of a plurality of components.

Regarding the relation between the trapping portion 8 and the conveying member 5, the trapping portion 8 may be disposed to be either contacted with the conveying member 5 or not contacted with the conveying member 5.

Concerning a structure into which the trapping portion 8 is incorporated, a trapping member having the trapping portion 8 may be attached to an inner wall surface of the conveying path 4. Alternatively, a trapping member having the trapping portion 8 may be attached to the side of the conveying member 5. Alternatively, the trapping portion 8 may be formed integrally with all or a part of the conveying member 5.

Additionally, it is sufficient to place the trapping portion 8 at least at one place. However, from the viewpoint of enhancing the ability to trap foreign matters, preferably, the trapping portions 8 are disposed at a plurality of places along the conveying path 4 in a toner conveying direction.

A preferable layout of the trapping portion 8 and the conveying member 5 is such that the conveying member 5 rotatably extends in the toner conveying direction and is disposed to penetrate through the trapping portion 8.

It is important to ensure the ability to trap foreign matters by simultaneously circumventing the interference between the contact type trapping portion 8 and the conveying member 5. A preferred example of the configuration of the contact type trapping portion 8 is such that the trapping portion 8 is fixed to the outside of the conveying member 5 and is disposed to be contacted with the conveying member 5, and that at least a part of the trapping portion 8 is contacted with the conveying member 5 and includes an elastically deformable resilient member.

On the other hand, an example of the configuration of the non-contact type trapping portion 8 is such that the non-contact type trapping portion 8 is disposed in a space region provided above the conveying member 5 in the conveying path 4 so as to trap floating foreign matters.

Another example of the trapping portion 8 has a hook part at which a foreign matter conveyed by the conveying member 5 is hooked. Examples of the configuration of such a trapping portion 8 are such that the trapping portion is suspended from an upper part of a path partitioning member of the conveying path 4 and has a hook part at an end thereof, and that the trapping portion provided in the conveying member 5 has a hook part.

Hereinafter, the invention is described in more detail with reference to embodiments shown in the accompanying drawings.

First Embodiment

Figure 2:
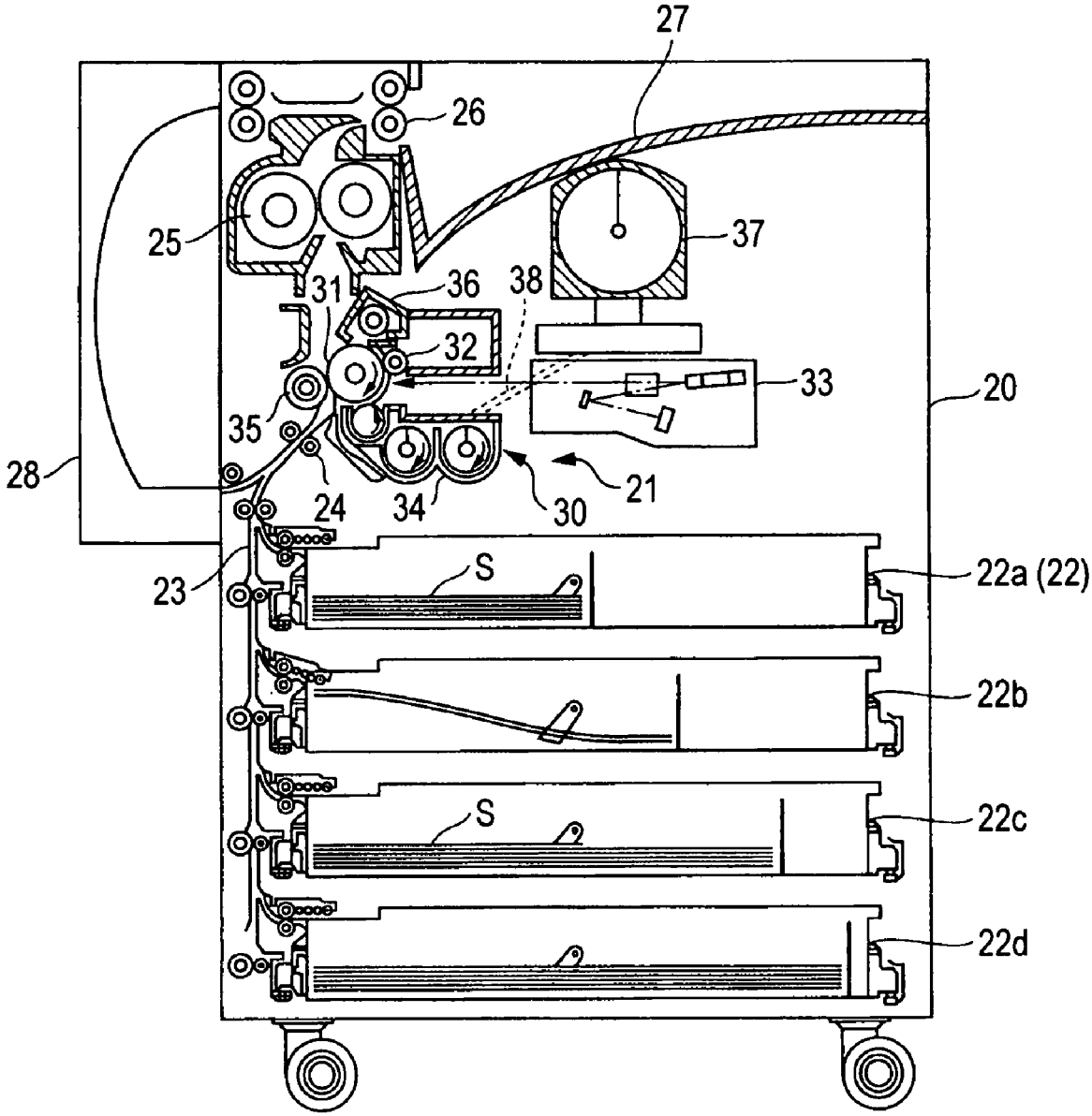
FIG. 2 is an explanatory view illustrating the entire configuration of a first embodiment of the image forming apparatus to which the invention is applied.

FIG. 2 illustrates the entire configuration of a first embodiment of an image forming apparatus to which the invention is applied. FIG. 2 is a view illustrating the inside of the apparatus, which is taken from the front side (or near side).

(Entire Configuration of Image Forming Apparatus)

As shown in FIG. 2, the image forming apparatus is configured so that for example, an electrographic image forming engine 21 is mounted in an apparatus housing 20, that a predetermined number (for example, 4) of supply trays 22 (22*a* to 22*d*) capable of supplying sheets of paper as recording media are disposed below the image forming engine 21 in the apparatus housing 20. A discharge tray 27 capable of accommodating sheets of recorded paper is provided at the top portion of the apparatus housing 20. A paper conveying path 23 adapted to guide sheets of paper S sent from each of the supply trays 22 to the image forming engine 21 and the discharge tray 27 is provided at a side surface side (the left side, as viewed in FIG. 2) in the apparatus housing 20 to extend substantially vertically.

According to the present embodiment, the image forming engine 21 includes a photoreceptor drum 31 capable of holding an electrostatic latent image, an electrification unit 32, for example, an electrification roll, configured to perform electrification of the photoreceptor drum 31, an exposure unit 33, for example, a laser scanning unit configured to write the electrostatic latent image formed on the photoreceptor drum 31, a developing unit 34 configured to perform the toner development of the electrostatic latent image formed on the photoreceptor drum 31, a transfer unit 35 using, for example, a transfer roll configured to transfer the electrostatic latent image formed on the photoreceptor drum 31 onto a sheet of paper S, and a toner removing unit 36 configured to remove residual toner remaining on the photoreceptor drum 31.

Incidentally, in the present embodiment, the developing unit 34 employs the two-component developing method. Toner can be supplied from a toner box 37, which accommodates a supplement toner, thereto through a supply path 38.

A positioning roll 24 configured to position and convey a sheet of paper S is provided at the upstream side of the photoreceptor drum 31 in the paper conveying path 23. A fixing unit 25 is disposed at the downstream side of the photoreceptor drum 31 in the paper conveying path 23. A discharge roll 26 is provided just in front of the discharge tray 27.

According to the present embodiment, a two-sided printing unit 28 enabled to perform two-sided printing on a sheet of paper is provided in the apparatus housing 20.

Figure 3:
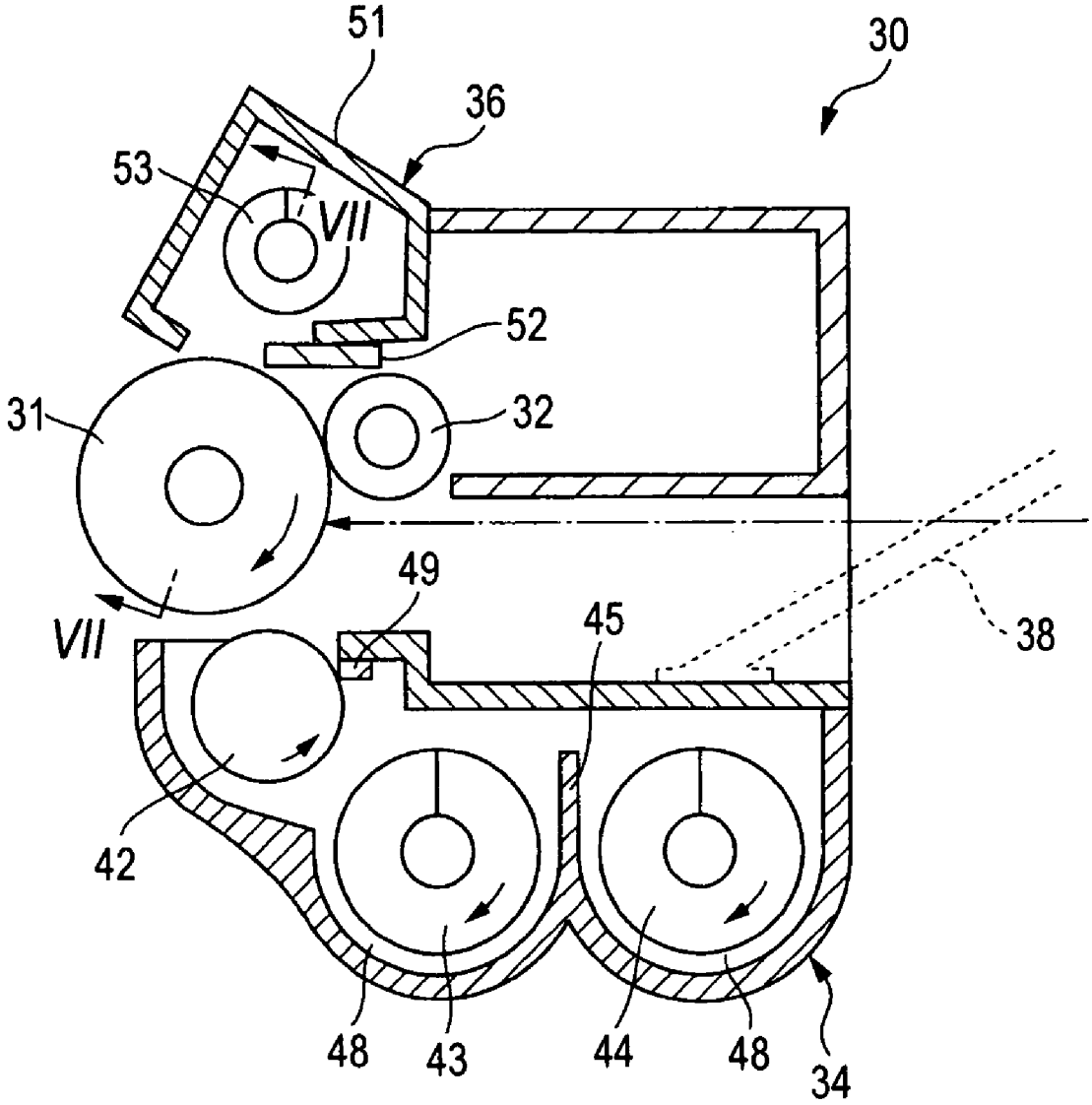
FIG. 3 is an explanatory view illustrating an outline of a process cartridge used in the first embodiment, which is taken from the front of the apparatus.
Figure 4:
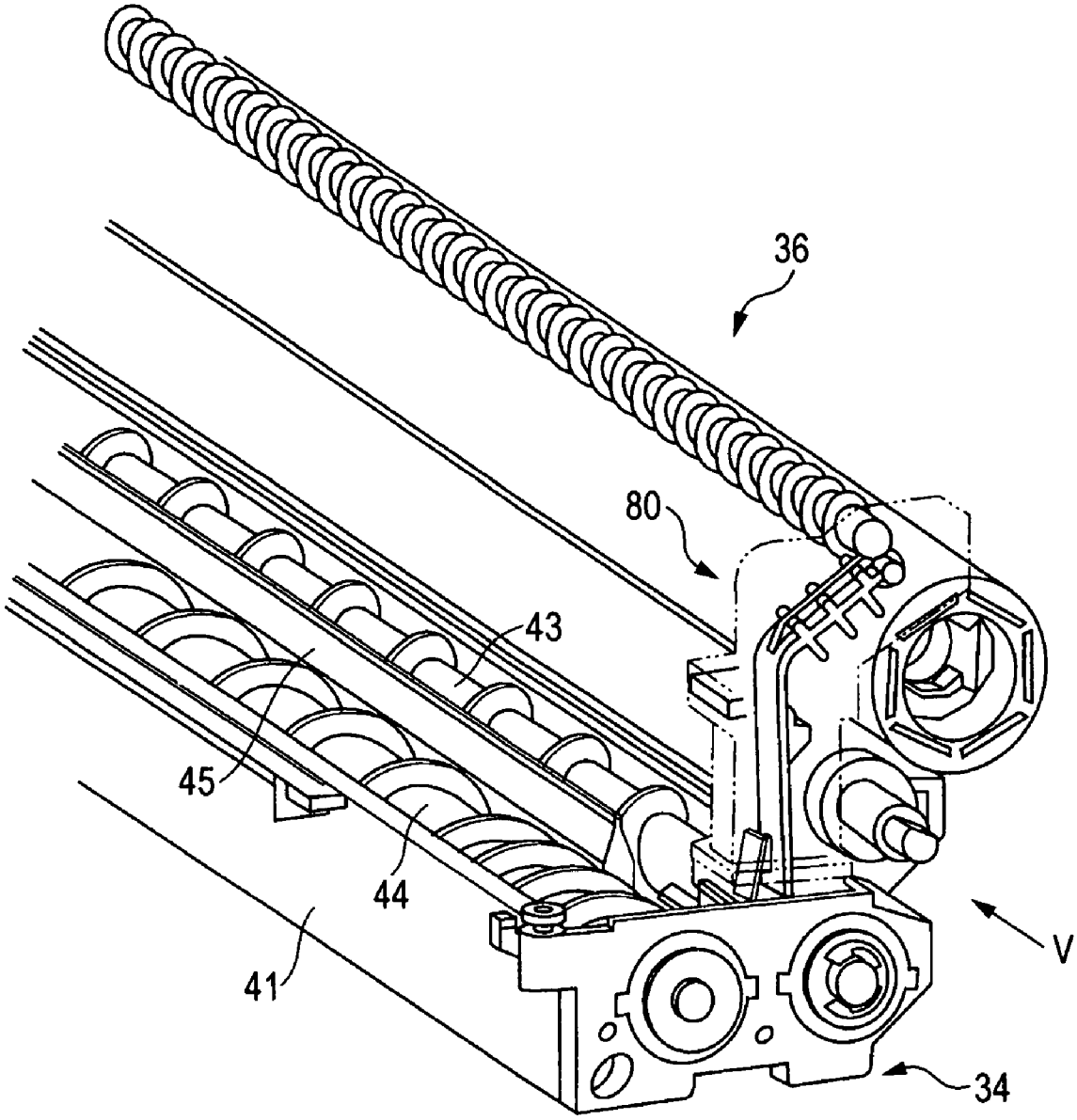
FIG. 4 is an explanatory view illustrating an outline of a process cartridge used in the first embodiment, which is taken from the rear of the apparatus.
Figure 5:
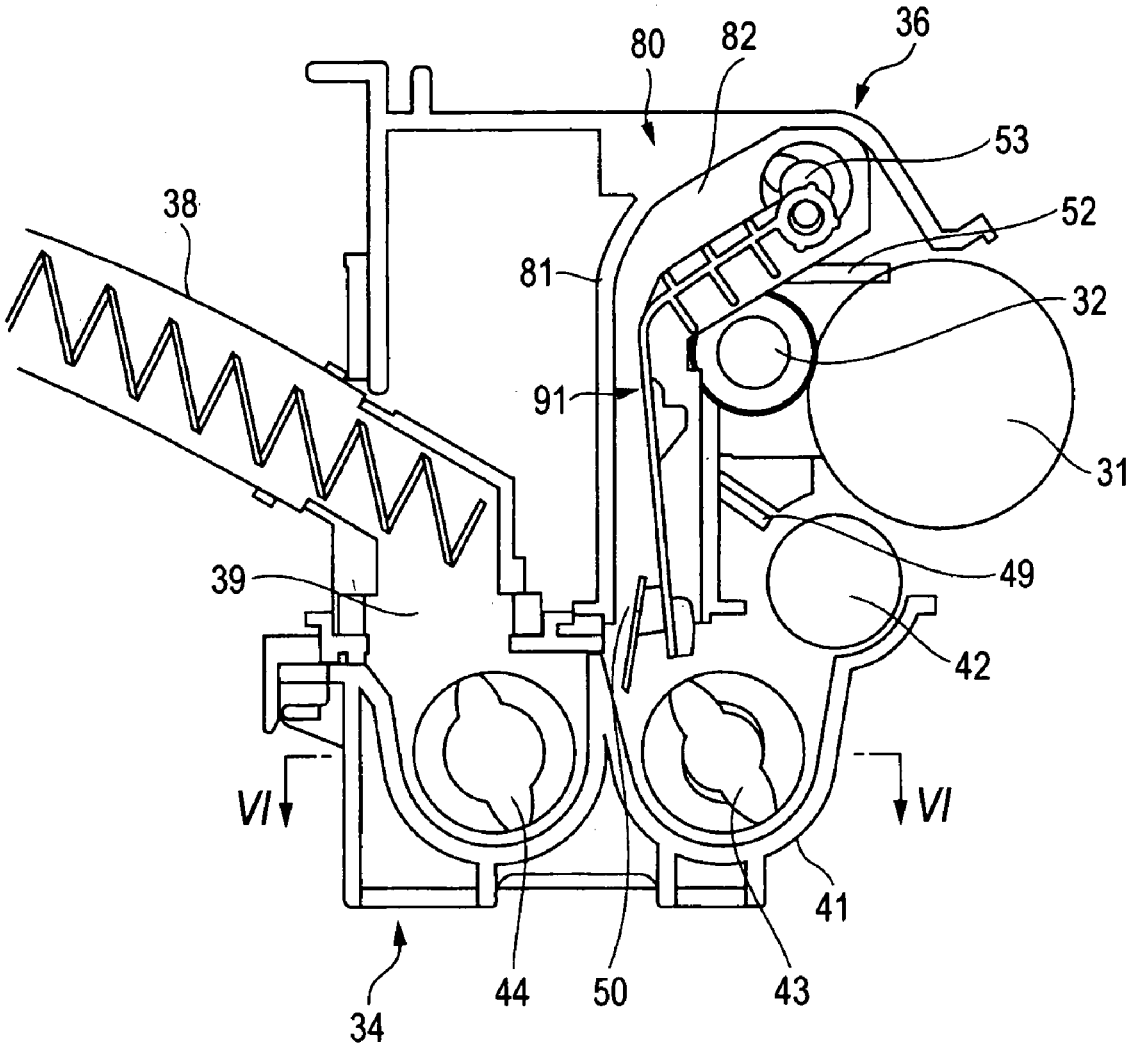
FIG. 5 is a view taken in the direction of an arrow V shown in FIG. 4.
Figure 6:
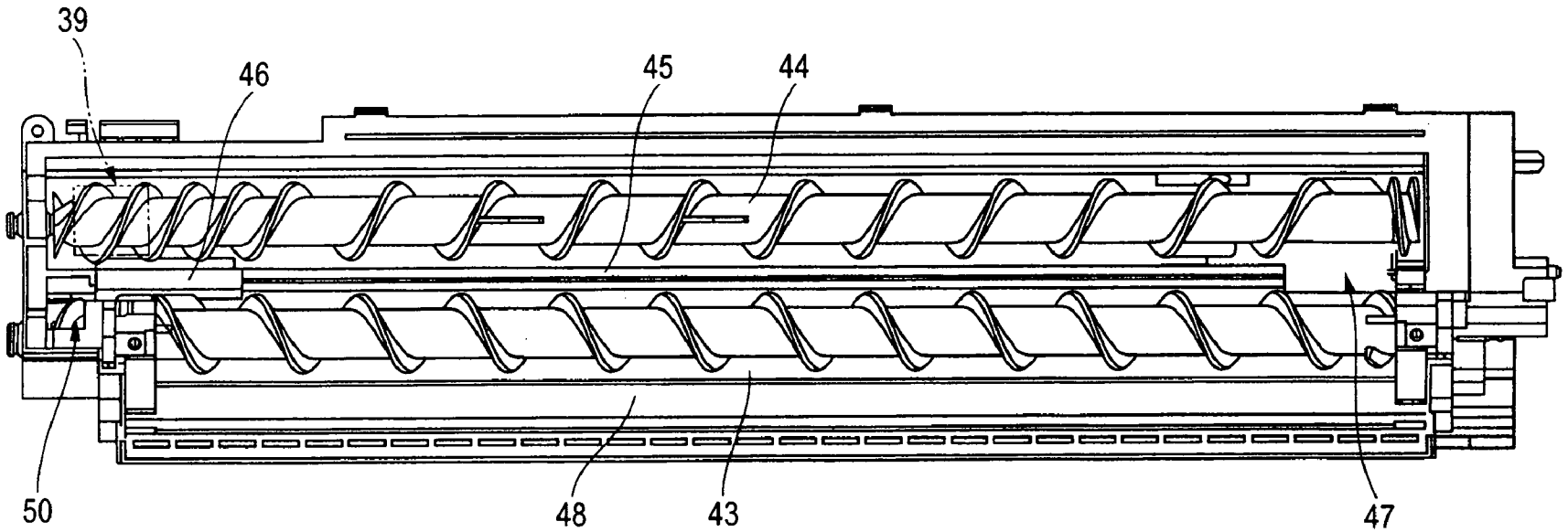
FIG. 6 is an explanatory cross-sectional view taken along line VI-VI shown in FIG. 5.

According to the present embodiment, the image forming engine 21 serving as an example of an image forming member is configured so that a process cartridge is formed by integrating the photoreceptor drum 31, the electrification unit 32, the developing unit 34, and the toner removing unit 36 as shown in FIGS. 3 to 5.

FIG. 3 illustrates a primary part of the process cartridge 30 shown in FIG. 2. FIG. 4 is a perspective view of the process cartridge 30, which is taken from the rear side thereof. FIG. 5 is a view of the process cartridge 30 taken in the direction of an arrow V shown in FIG. 4.

Especially, according to the present embodiment, the process cartridge 30 reuses toner by returning toner, which is collected by the toner removing unit 36, to the developing unit 34. As shown in FIGS. 4 and 5, the conveying path is provided between the toner removing unit 36 and the developing unit 34.

(Developing Unit)

As shown in FIGS. 3 to 6, the developing unit 34 is provided below the toner removing unit 36. The developing unit 34 includes a developer accommodating container 41 which accommodates a two-component developer including toner and carrier and which is opened at the side of the photoreceptor drum 31. A developing roll 42 is rotatably disposed at a part facing the opening formed in the developer accommodating container 41. Paired agitation conveying members 43 and 44 are disposed along the direction of an axis of the developing roll 42 in the developer accommodating container 41. A partitioning plate 45 is provided between the paired agitation conveying members 43 and 44. Each of communication holes 46 and 47 is provided in the vicinity of an associated one of both ends in the longitudinal direction of the partitioning plate 45. Thus, a developer circulation path 48, in which the circulation conveyance of the developer can be performed, is constituted. Incidentally, reference numeral 49 is a layer regulating member adapted to regulate a developer layer formed on the developing roll 42.

The agitation conveying member 43 placed at the side of the developing roll 42 functions mainly as a supply member used to supply the developer from the developing roll 42. On the other hand, the agitation conveying member 44 provided at a far side from the developing roll 42 functions mainly as an agitation member used to agitate the developer. A driving force is transmitted from a drive motor (not shown) to the agitation conveying members 43 and 44 through a driving force transmitting mechanism (not shown) including gear trains.

A toner supply port 39 is opened in the vicinity of the upstream end of the agitation conveying member 44 in the developer accommodating container 41. A supply path 38 connected to the toner box 37 is connected to the toner supply port 39. A reuse toner supply port 50 is opened in the vicinity of the downstream end of the agitation conveying member 43 in the developer accommodating container 41.

(Toner Removing Unit)

As shown in FIGS. 3, 4, 7A and 7B, the toner removing unit 36 has a case 51 that is provided at a place located in an obliquely upward direction of the photoreceptor 31 and that is opened at the side of the photoreceptor drum 31. A blade 52 serving as a cleaning member for removing the residual toner, which abuts against the photoreceptor drum 31, is provided at an opening edge of the case 51. A collected toner conveying member 53 adapted to rotate to collect the toner removed by the blade 52 toward an end in the longitudinal direction of the case 51 is also disposed in the case 51.

Figure 7A:
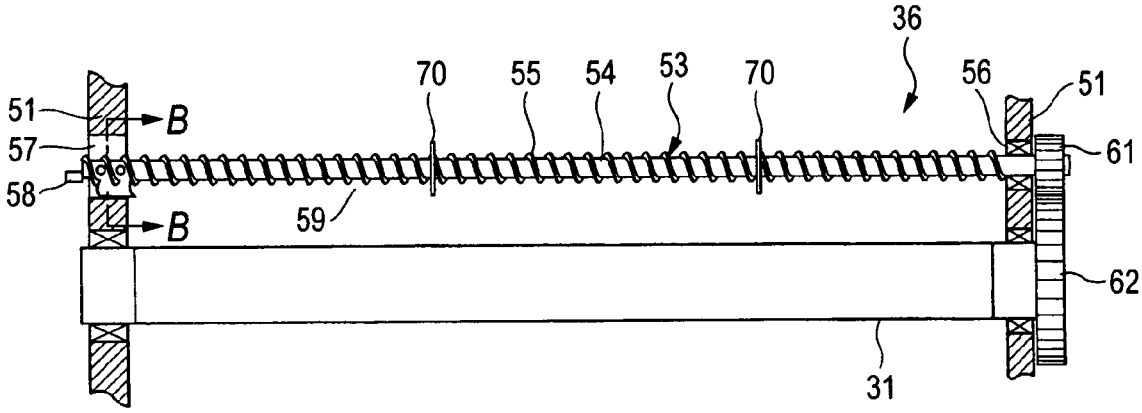
FIG. 7A is a cross-sectional view taken along line VII-VII shown in FIG. 3.
Figure 7B:
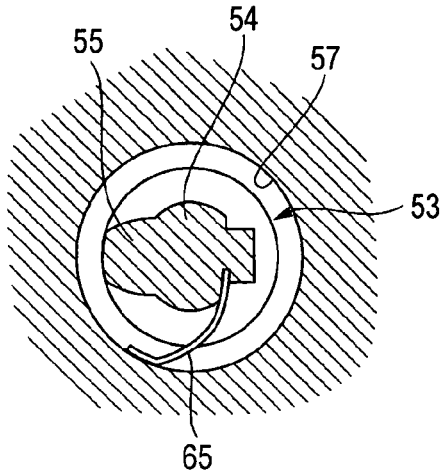
FIG. 7B is a cross-sectional view taken along line B-B shown in FIG. 7A.
Figure 8:
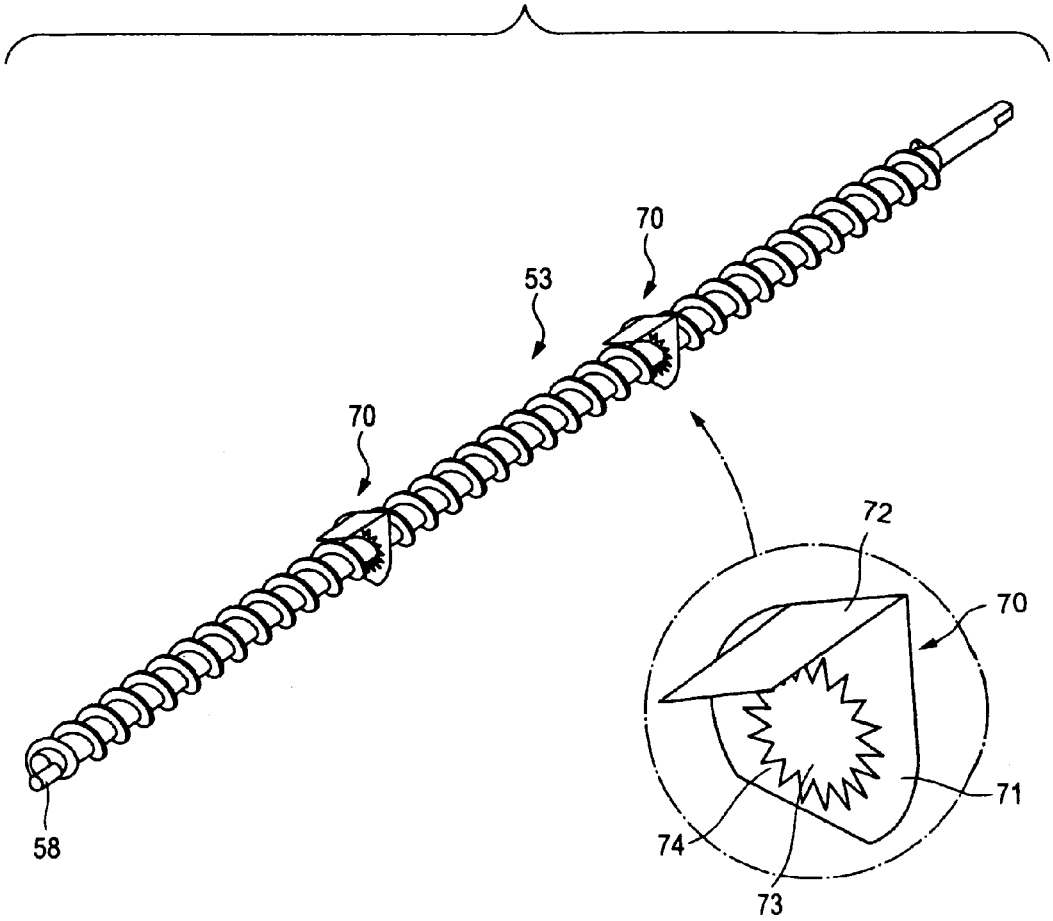
FIG. 8 is an explanatory view illustrating the configuration of the periphery of a collected toner conveying member of a toner removing unit used in the first embodiment.
Figure 9A:
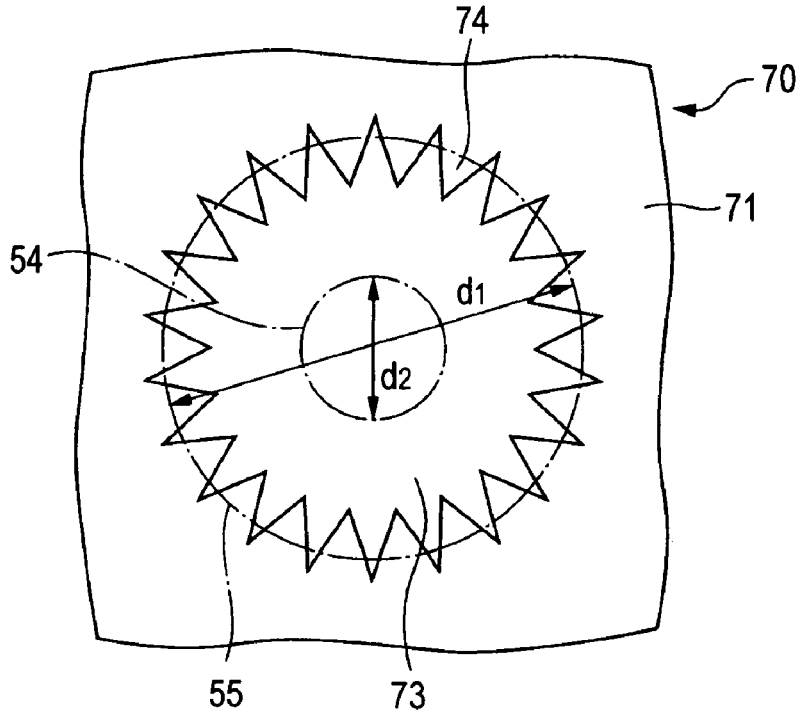
FIG. 9A is an explanatory view illustrating an outline of a trapping member used in the first embodiment.
Figure 9B:
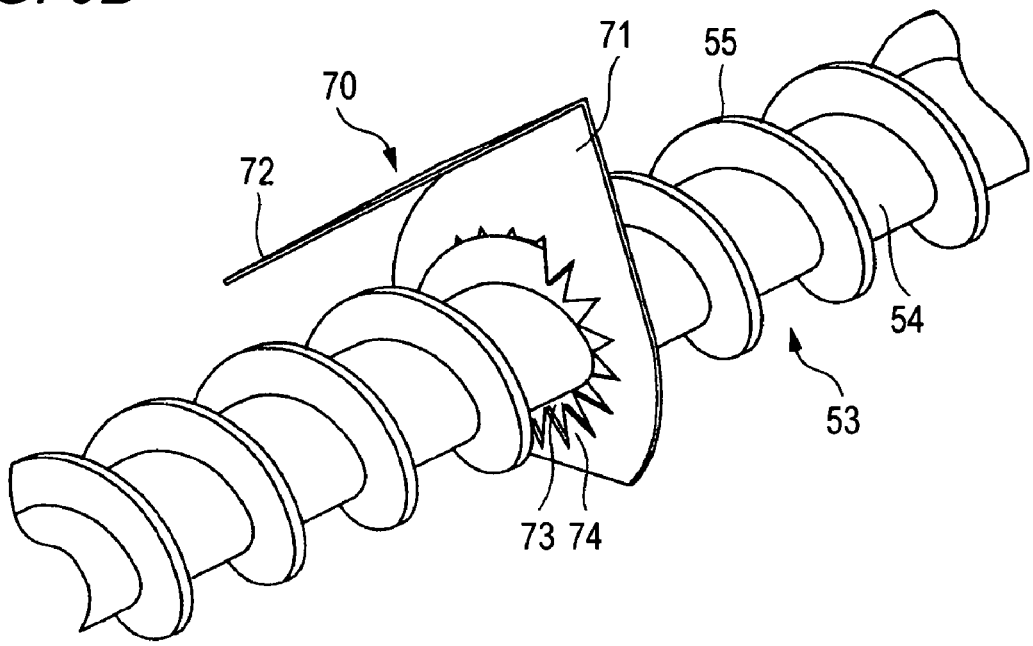
FIG. 9B is an explanatory view illustrating a state in which a trapping sheet is attached.

The collected toner conveying member 53 has a spiral blade member 55 provided around a rotating shaft 54 for conveying the collected toner, as shown in FIGS. 7A and 7B. An upstream end part of the rotating shaft 54 for conveying the collected toner is rotatably supported on an end wall of the case 51 through a bearing 56. A downstream end part of the rotating shaft 54 for conveying the collected toner is disposed to rotatably penetrate through, for example, a circular collected toner discharge port 57 formed in the other end wall of the case 51. A support portion 58 adapted to support a conveying member 91 is provided at a place which is eccentric from the center of rotation.

A drive system for the collected toner conveying member 53 is configured so that a driving force transmitting gear 61 is securely fixed to the upstream end part of the rotating shaft 54 for conveying the collected toner, and that, for example, a drive gear 62 of the photoreceptor drum 31 is meshed with the driving force transmitting gear 61, and that a driving force outputted from a drive motor (not shown) is transmitted to the drive gear 62 and the driving force transmitting gear 61 through, for example, a driving force transmitting mechanism (not shown) of the developing unit 34.

Also, according to the present embodiment, a coagulated toner pulverizing member 65 fixed to the downstream side end part of the rotating shaft 54 for conveying the collected toner is disposed in the collected toner discharge port 57. The coagulated toner pulverizing member 65 includes, for example, an elastic film one end of which is attached by melting to the circumferential surface of the downstream end part of the rotating shaft 54 for conveying the collected toner. The elastic film 65 abuts against the inner circumferential surface of the collected toner discharge port 57. When rotationally driving the collected toner conveying member 53, the elastic film 65 rotates to pulverize the coagulated toner while sliding on the inner circumferential surface of the collected toner discharge port 57.

As shown in FIGS. 7A to 9B, according to the present embodiment, the collected toner conveying path 59 is provided in the case 51 of the toner removing unit 36 so that the collected toner is conveyed by the collected toner conveying member 53. A plurality (two in the present embodiment) of trapping sheets 70 serving as the trapping member adapted to trap foreign matters, such as fibrous dusts, are provided in the collected toner conveying path 59.

The trapping sheet 70 has a sheet substrate made of a flexible or elastic material, for example, polyimide. A fixing attachment piece 72, such as a double-sided tape is provided at one end of the sheet substrate 71. On the other hand, a through hole 73, through which the collected toner conveying member 53 can pass, is opened in the sheet substrate 71. A plurality of sharp-tipped projection portions 74, for example, triangular projection portions 74 are formed along the opening edge of the through hole 73.

The shape of the opening of the through hole 73, which is other than the projection portions 74, is substantially circular. The opening of the through hole 73 is formed so that the diameter of the opening is slightly larger than an outside diameter d1 of the spiral blade 55 of the collected toner conveying member 53. A virtual circle obtained by connecting the end positions of the projection portions 74 may appropriately be selected. In consideration of the shape maintainability of the projection portions 74, preferably, the diameter of the virtual circle is set to be larger than the outside diameter d2 of the rotating shaft 54 of the collected toner conveying member 53.

(Toner Return Mechanism)

A toner return mechanism 80 according to the present embodiment, which is configured to return the toner discharged from the collected toner discharge port 57 of the toner removing unit 36 to a reuse toner supply port 50 of the developing unit 34 is described below.

Figure 10:
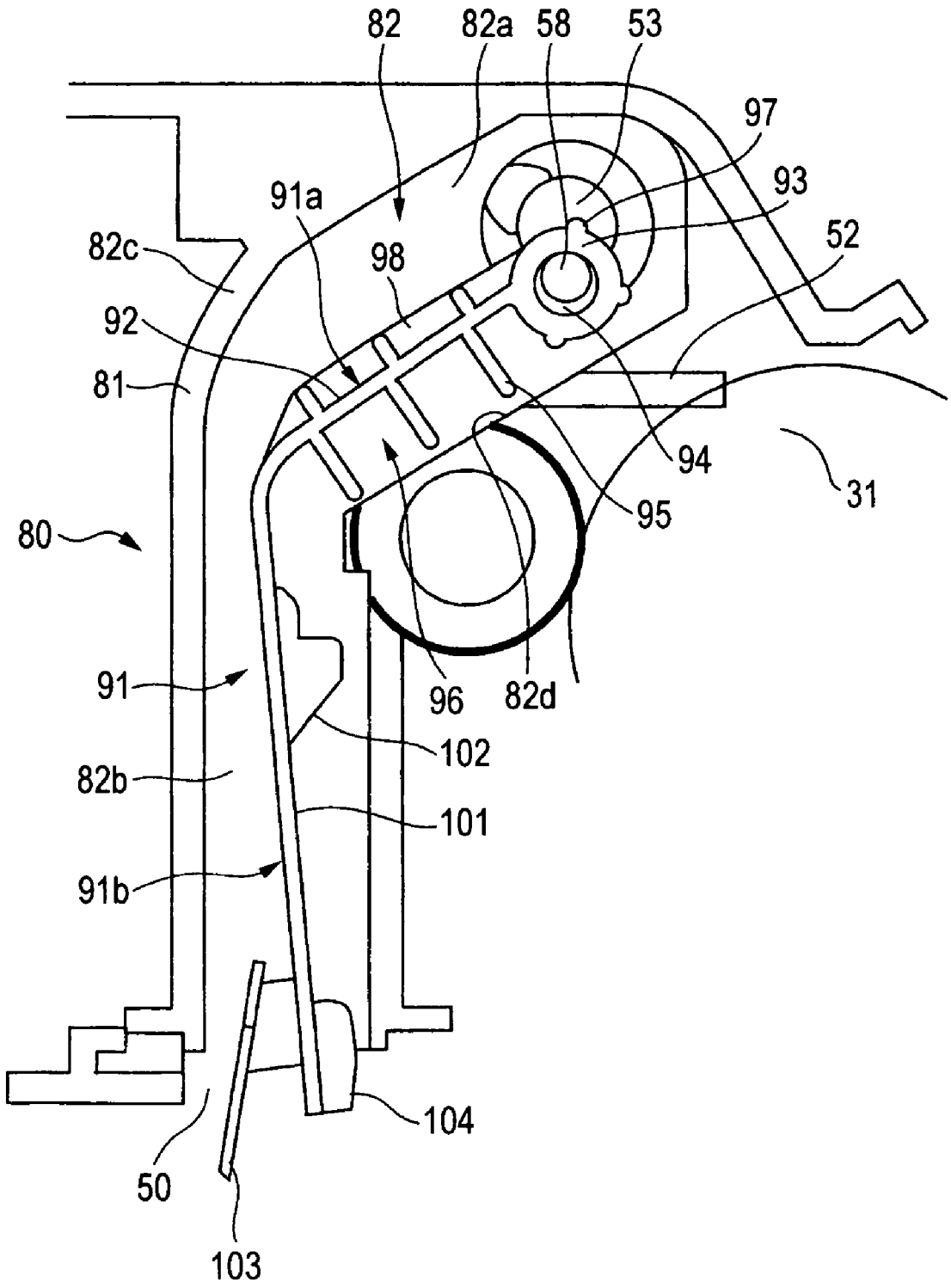
FIG. 10 is an explanatory view illustrating a toner return mechanism used in the first embodiment in detail.

As shown in FIGS. 4, 5, and 10, the toner return mechanism 80 is configured so that the collected toner discharge port 57 of the toner removing unit 36 and the reuse toner supply port 50 of the developing unit 34 are connected by a connecting tube 81 for conveying reuse toner, that a reuse toner conveying path 82 for conveying the toner collected by the toner removing unit 36 is formed in the connecting tube 81, and that a conveying member 91 is disposed in the reuse toner conveying path 82.

Hereinafter, the reuse toner conveying path 82 is described in detail. The reuse toner conveying path 82 is formed by connecting a first conveying path 82*a*, which is downwardly inclined from the position of the collected toner discharge port 57 of the toner removing unit 36 at, for example, an angle that is equal to or less than a toner rest angle, through a bending portion 82*c* to a second conveying path 82*b* upwardly extending from the reuse toner supply port 50 of the developing unit 34. The bottom surface of the first conveying path 82*a*, and a side surface of the second conveying path 82*b*, which is connected to the bottom surface of the first conveying path 82*a* and substantially vertically extends, are used as a toner conveying surface 82*d*.

The conveying member 91 moves along the reuse toner conveying path 82. The conveying member 91 includes a first conveying member 91*a*, which reciprocates along the first conveying path 82*a* of the reuse toner conveying path 82, and also includes a second conveying member 91*b* that is formed integrally with the first conveying member 91*a* to extend substantially vertically at the downstream side thereof in the toner conveying direction and is disposed in the second conveying path 82*b*.

Now, the shape of the conveying member 91 is described below.

First, the first conveying member 91*a* has a plate-like substrate 92, which is molded using a resin material, for example, PP. ABS, or POM, and which extends along the toner conveying direction of the first conveying path 82*a*. A catching portion 93, which has a circular catching hole 94 and serves as a driving force input portion, is provided at the upstream end in the toner conveying direction of the plate-like substrate 92.

Also, a plurality of plate-like blades 95 protruding toward the toner conveying surface 82*d* of the first conveying path 82*a* are arranged at predetermined intervals under the plate-like substrate 92.

Also, a plurality of plate-like blades 95 protrude around the catching portion 93 and the plate-like substrate 92 of the first conveying member 91*a*.

Also, the second conveying member 91*b* is formed integrally with the first conveying member 91*a* so that an obtuse angle is formed therebetween. The second conveying member 91*b* has an elongated plate-like substrate 101 whose bottom portion extends into the reuse toner supply port 50 of the developing unit 34. A projection portion 102 protruding toward the toner conveying surface 82*d* of the second conveying path 82*b* is provided on a side surface of the plate-like substrate 101. A toner scraping-down portion 103 is formed, for example, integrally with a part disposed in the reuse toner supply port 50 in the vicinity of the bottom end of the plate-like substrate 101.

Additionally, according to the present embodiment, the catching portion 93 of the first conveying member 91*a* is driven by and connected to the collected toner conveying member 53. The mounting of the catching portion 93 is performed by catching the support portion 58 in the catching hole 94 thereof. The catching portion 93 of the first conveying member 91*a* is turned through the support portion 58 to have a substantially circular locus or an elliptic orbit that is flattened in an up-down direction.

(Operation of Apparatus)

Next, an operation of the image forming apparatus according to the present embodiment is described below.

Upon completion of electrification of a surface of the photoreceptor drum 31 by the electrification unit 32, the photoreceptor drum 31 is exposed according to input image data by the exposure unit 33 to thereby form an electrostatic latent image. On the other hand, the developing unit 34 is supplied with toner from the toner box 37. A developer is agitated and conveyed in the developing unit 34. The electrostatic latent image formed on the photoreceptor drum 31 is developed through the developing roll 42 of the developing unit 34. Thus, a toner image is formed on the photoreceptor drum 31. The formed toner image is transferred onto a sheet of paper S at a transfer part at which the transfer unit 35 abuts against the photoreceptor drum 31. The toner image is outputted from the fixing unit 25 by being thermally fixed. On the other hand, after the transfer, the toner remaining on the photoreceptor drum 31 is peeled off the photoreceptor drum 31 and is collected by the blade 52 of the toner removing unit 36.

Subsequently, the toner collected in the toner removing unit 36 is conveyed by the collected toner conveying member 53 along the collected toner conveying path 59 to the collected toner discharge port 57 of the case 51 of the toner removing unit 36.

At that time, the collected toner conveying member 53 conveys foreign matters, for example, fibrous dusts together with the toner. The trapping sheet 70 is disposed on the middle portion of the collected toner conveying member 53. Thus, when the spiral blade 55 of the collected toner conveying member 53 passes through the through hole 73 of the trapping sheet 70, the projection portion 74 of the trapping sheet 70 touches the surface of the blade member 55 while causing flexible deformation (or elastic deformation) as the projection portion 74 of the trapping sheet 70 moves.

In this state, the foreign matters, such as the fibrous dusts, are caught and trapped by the projection portions 74 of the trapping sheet 70. On the other hand, fine toner particles pass through between the projections 74 of the trapping sheet 70 without being trapped, and go to the collected toner discharge port 57. The foreign matters trapped by the trapping sheet 70 are entwined with the projection portions 74. Thus, the trapped foreign matters are hardly disengaged from the trapping sheet 70 and maintain the trapped state during the life of the process cartridge 30.

Especially, according to the present embodiment, the trapping sheets 70 are provided at a plurality of places, so that foreign matters are effectively trapped at a plurality of places.

Thereafter, when the collected toner reaches the collected toner discharge port 57 of the toner removing unit 36, the coagulated toner pulverizing member 65 pulverizes coagulated toner. Thus, the collected toner is discharged from the collected toner discharge port 84 to the toner return mechanism 80 without being coagulated. Incidentally, although the coagulated toner pulverizing member 65 is provided in the present embodiment, the present embodiment may be modified by omitting the coagulated toner pulverizing member 65.

Especially, according to the present embodiment, the trapping sheet 70 allows the collected toner to pass therethrough by being uniformized, in addition to the trapping of foreign matters such as fibrous dusts. Thus, the present embodiment is preferable in that coagulated toner is pulverized to some extent when the toner passes through the trapping sheet 70.

Subsequently, the collected toner is returned to the developing unit 34 through the toner return mechanism 80.

At that time, as the support portion 58 turns, the conveying member 91 performs circulation movement in the toner return mechanism 80. However, the first conveying member 91*a* performs linear movement along the toner conveying direction. Also, the first conveying member 91*a* moves in a direction opposite to the toner conveying direction so as not to follow the toner conveying surface 82*d*. Thus, good toner conveyability is maintained in the first conveying path 82*a*.

Additionally, the second conveying member 91*b* can be approached to and separated from the toner conveying surface 82*d* of the second conveying path 92*b*. When contacted with the toner conveying surface 82*d*, the second conveying member 91*b* rectilinearly moves. During the toner is conveyed by the first conveying member 91*a*, it is advisable to make the second conveying member 91*b* away from the toner conveying surface 82*d*. Thus, the toner adhering to the toner conveying surface 82*d* is effectively scraped down. Also, the free fall of the toner from the first conveying path 82*a* to the second conveying path 82*b* is not prevented. Consequently, good toner conveyability is also maintained in the second conveying path 82*b*.

Thus, according to the present embodiment, good toner conveyability is maintained in both the first conveying path 82*a* and the second conveying path 82*b*.

Additionally, the collected toner having been returned to the reuse toner supply port 50 of the developing unit 34 is agitated and mixed with carrier together with existing toner and supplement toner by the agitation conveying members 43 and 44. Then, the collected toner in a sufficiently electrified state is supplied to the developing roll 42.

Second Embodiment

Figure 11:
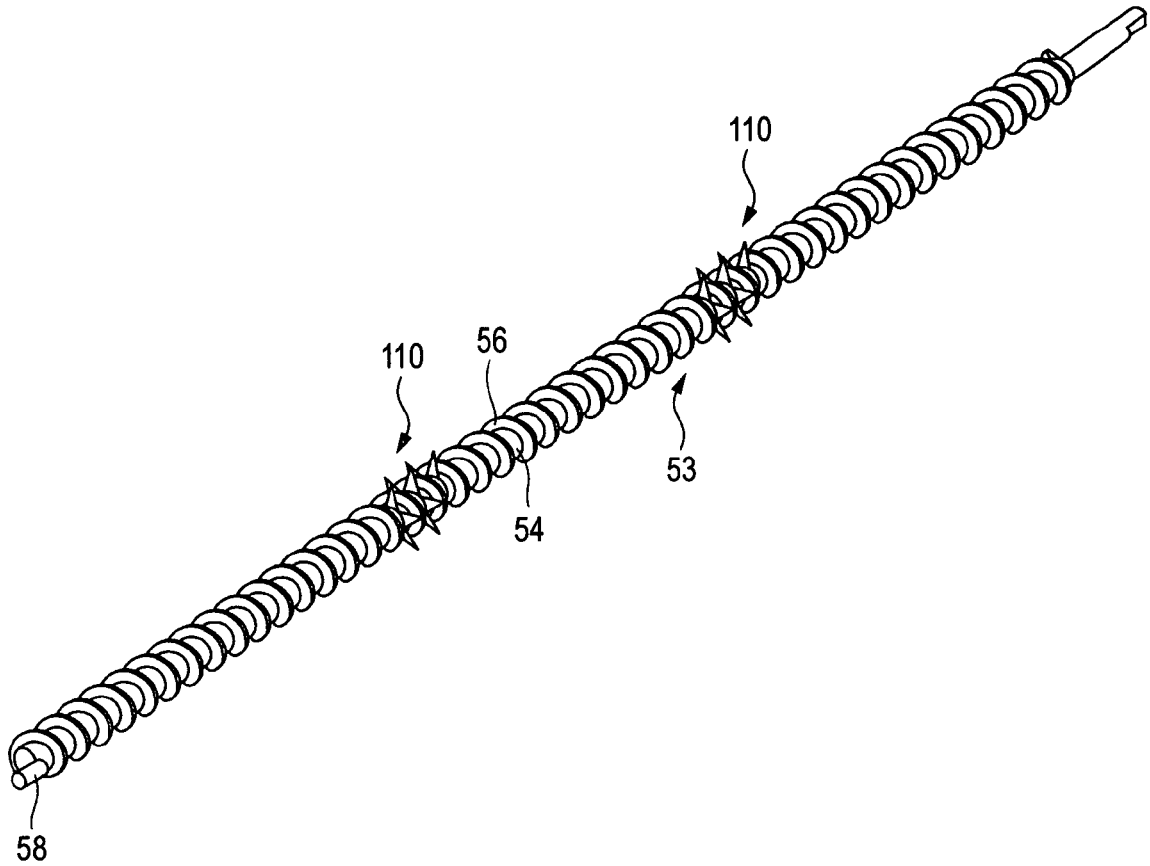
FIG. 11 is an explanatory view illustrating the configuration of the periphery of a collected toner conveying member of a toner removing unit used in a second embodiment.

FIG. 11 is an explanatory view illustrating the configuration of the periphery of a collected toner conveying member of a toner removing unit used in a second embodiment.

As shown in FIG. 11, the basic configuration of the toner removing unit of the second embodiment is substantially the same as that of the first embodiment. However, the toner removing unit of the second embodiment uses a trapping mat 110 as the trapping member, differently from the first embodiment.

Figure 12A:
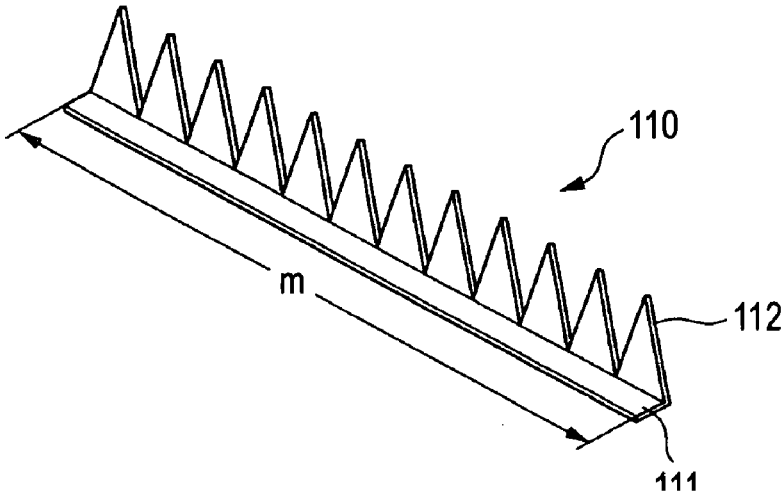
FIG. 12A is an explanatory view illustrating a trapping member used in the second embodiment.
Figure 12B:
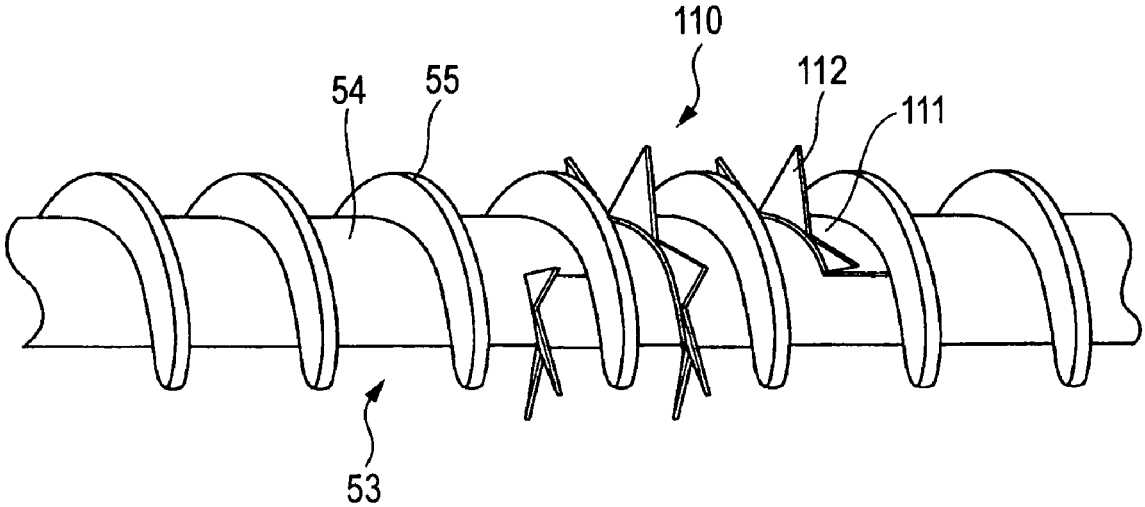
FIG. 12B is an explanatory view illustrating a state in which the trapping member is attached.

As shown in FIGS. 11 and 12A, the trapping mat 110 shown according to the present embodiment is produced by forming a plurality of projection portions 112, each of which is constituted by a sharp-tipped triangular member made of a flexible material, on a side edge of a flexible fixing attachment piece 111 (in the present embodiment, the piece 111 has a length longer than the outside circumference of the rotating shaft 54 for conveying the collected toner) such as a double-side tape. Incidentally, although the dimension of the projected part of each of the projection portions 112 may appropriately be set, this dimension is set to be longer than the length of a projected part in the radial direction of the blade member 55 according to the present embodiment.

Also, it is advisable for forming the trapping mat 110 to wind the flexible fixing attachment piece 111 around the collected toner conveyance rotating shaft 54 of the collected toner conveying member 53 along the spiral locus of the spiral blade 55. The trapping mat 110 is attached around the rotating shaft 54 in a state in which the plurality of projection portions 112 are protruded in the radial direction of the rotating shaft 54.

Consequently, according to the present embodiment, foreign matters such as fibrous dusts are conveyed together with toner by the collected toner conveying member 53 and are trapped by being entwined with the projection portions 112 of the trapping mat 110.

Figure 13A:
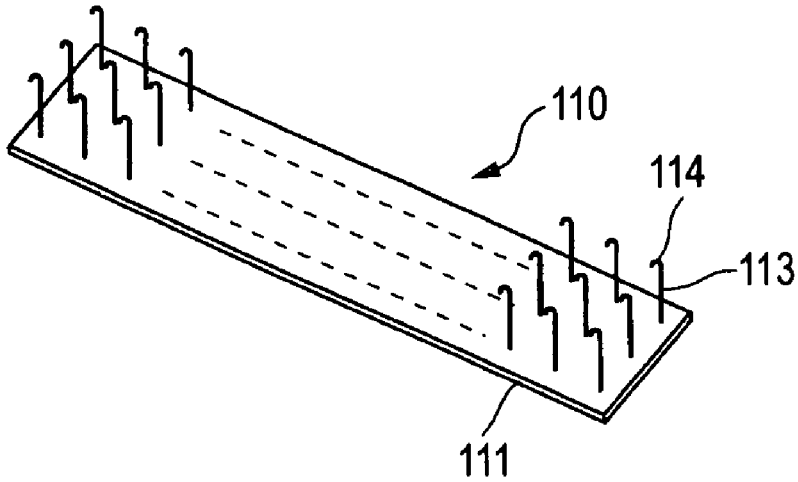
FIG. 13A is an explanatory view illustrating a modification of the trapping member used in the second embodiment.

Incidentally, the trapping mat according to the invention is not limited to the trapping mat 110 fixed to the collected toner conveying member 53 in the present embodiment. For example, a modification of a trapping mat is formed by implanting or fixing hook wire-like members 113 such as a plurality of bristles of a brush, which are constituted by nylon fibers, polypropylene fibers, polyester fibers, animal fibers, or plant fibers, on or to a flexible fixing attachment piece 111 and additionally forming a hook part 114 at each of end portion of the hook wire-like members 113, as shown in FIG. 13A.

Figure 13B:
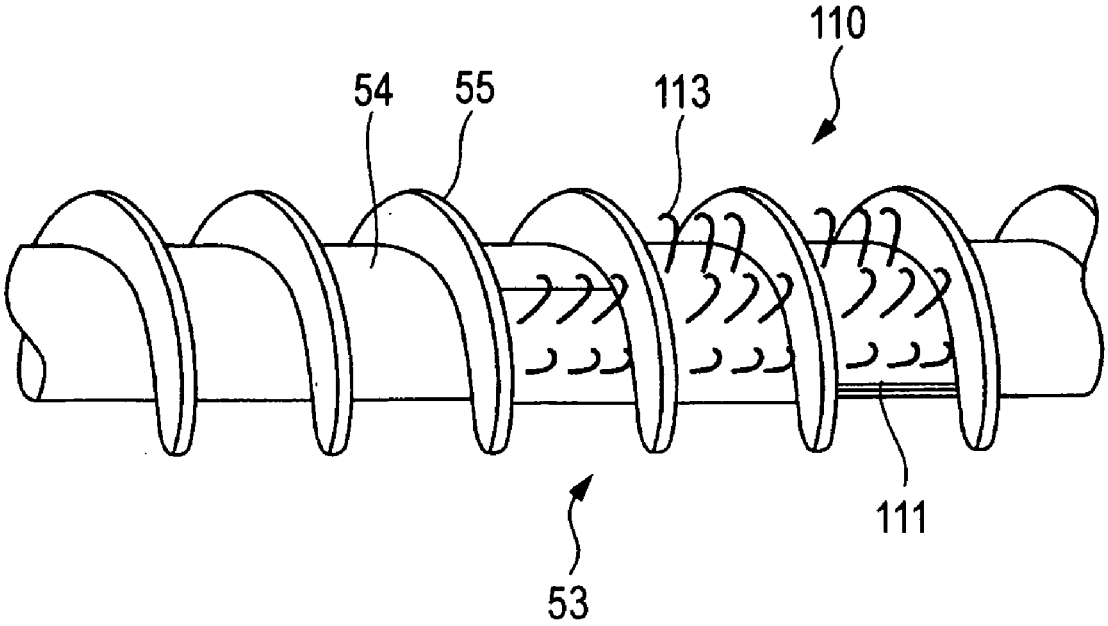
FIG. 13B is an explanatory view illustrating a state in which the trapping member shown in FIG. 13A is attached.

It is advisable for forming the trapping mat 110 to wind the flexible fixing attachment piece 111 around the collected toner conveyance rotating shaft 54 of the collected toner conveying member 53 along the spiral locus of the spiral blade 55, as shown in FIG. 13B. The trapping mat 110 is attached around the rotating shaft 54 in a state in which the plurality of hook wire-like members 113 are protruded in the radial direction of the rotating shaft 54.

Thus, even in the case of this modification of the first embodiment, foreign matters such as fibrous dusts are conveyed together with the toner by the collected toner conveying member 53 and are trapped by being entwined with the hook wire-like members 113 of the trapping mat 110.

Third Embodiment

Figure 14:
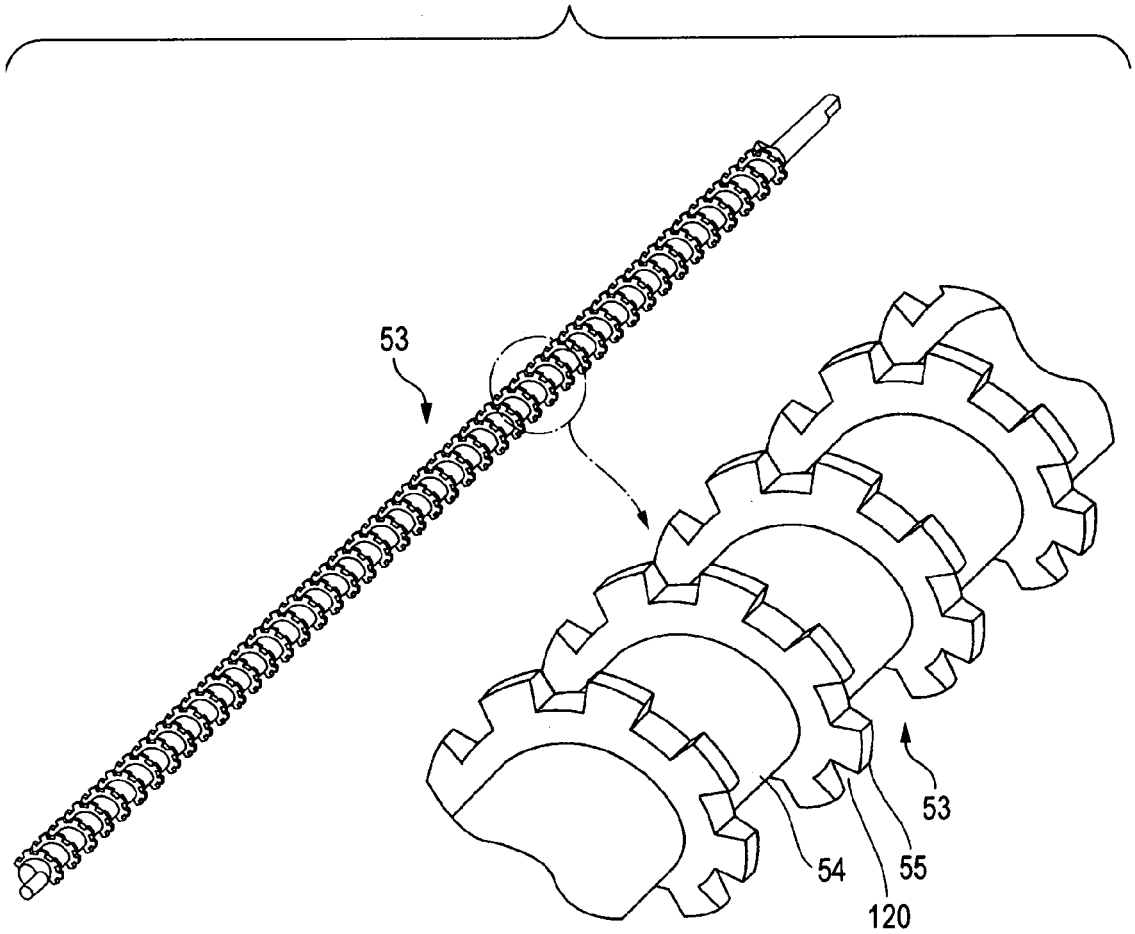
FIG. 14 is an explanatory view illustrating a collected toner conveying member of a toner removing unit used in a third embodiment.

FIG. 14 is an explanatory view illustrating the configuration of the periphery of a collected toner conveying member of a toner removing unit used in a third embodiment.

As shown in FIG. 14, the basic configuration of the toner removing unit of the third embodiment is substantially the same as that of the first embodiment. However, the third embodiment employs a trapping member different in structure from those of the first and second embodiments.

According to the third embodiment, the collected toner conveying member 53 is provided with spiral blades 55 around the rotating shaft 54 for conveying the collected toner. However, for example, substantially rectangular cutouts 120 are integrally formed at appropriate intervals around each of the spiral blades 55.

According to the present embodiment, the cutouts 120 of the collected toner conveying member 53 also have the function of the trapping portion. Foreign matters such as fibrous dusts are conveyed together with the toner by the collected toner conveying member 53 and are trapped by being entwined with the cutouts 120.

Fourth Embodiment

Figure 15:
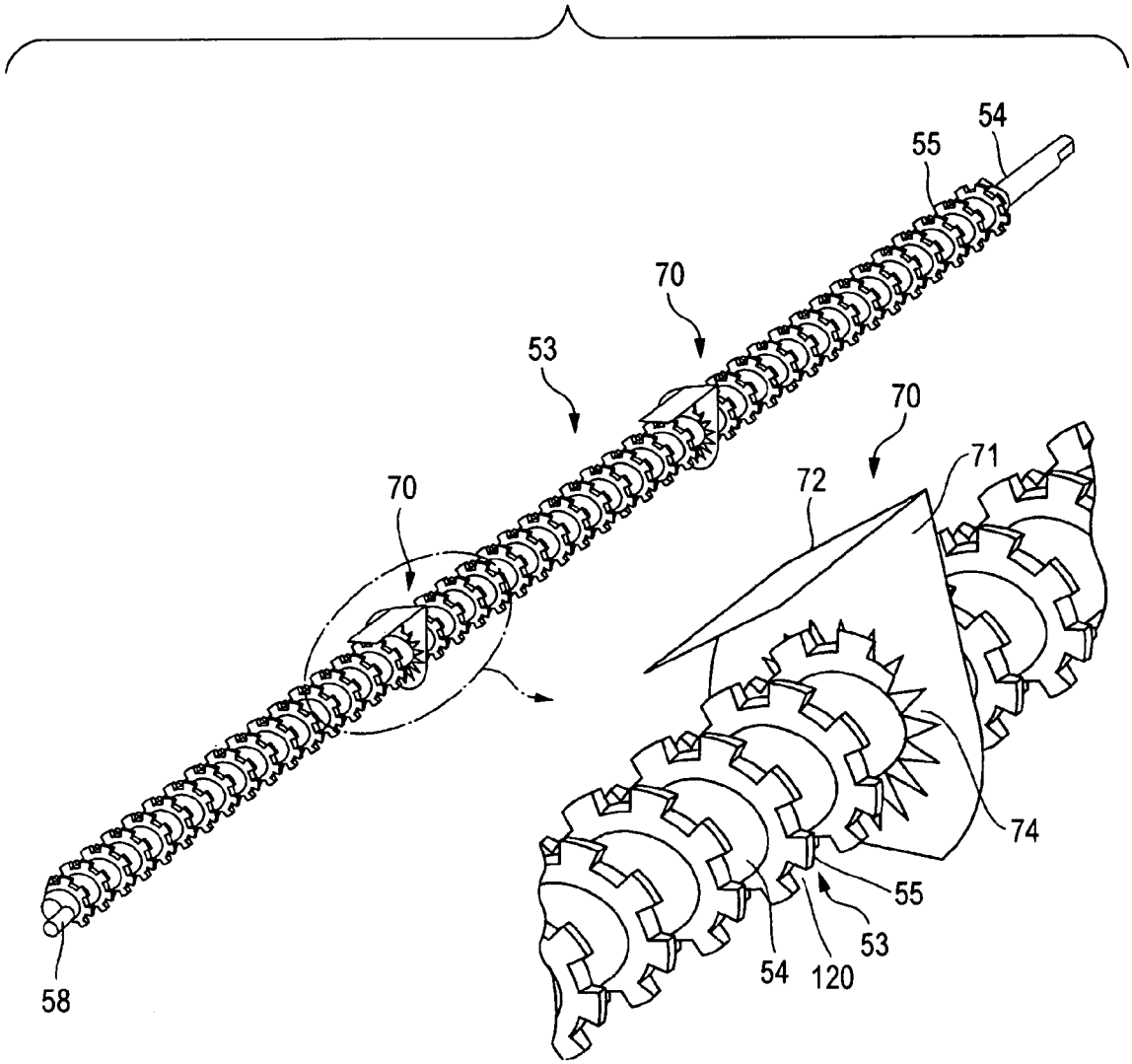
FIG. 15 is an explanatory view illustrating a collected toner conveying member of a toner removing unit used in a fourth embodiment and also illustrating the configuration of the periphery of this collected toner conveying member.

FIG. 15 is an explanatory view illustrating the configuration of the periphery of a collected toner conveying member of a toner removing unit used in a fourth embodiment.

As shown in FIG. 15, the basic configuration of the toner removing unit of the third embodiment is substantially the same as that of the first embodiment. However, according to the fourth embodiment, both the trapping sheet 70 of the first embodiment and each of the cutouts 120 of the collected toner conveying member 53 of the third embodiment are used.

According to the present embodiment, the ability to trap foreign matters such as fibrous dusts are further enhanced, as compared with the first and third embodiments.

Fifth Embodiment

Figure 16:
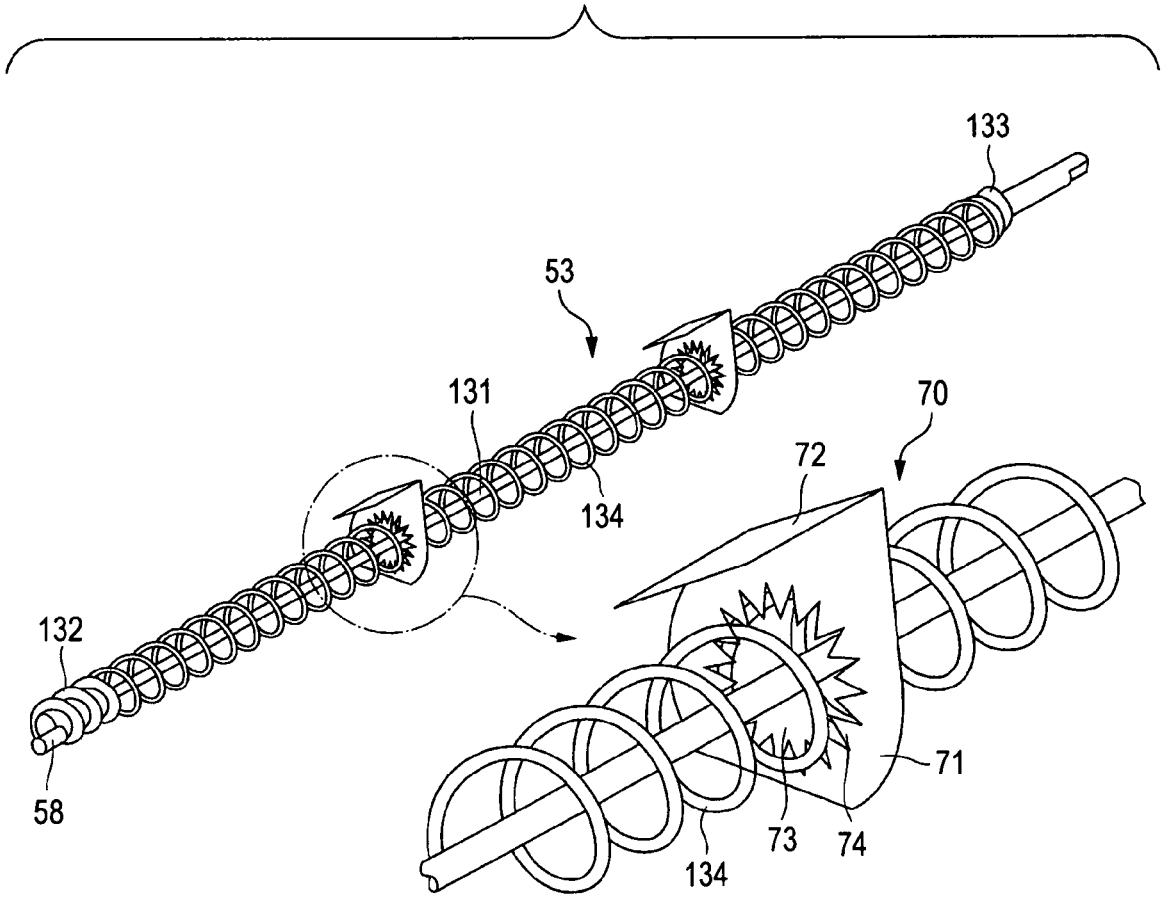
FIG. 16 is an explanatory view illustrating a collected toner conveying member of a toner removing unit used in a fifth embodiment and also illustrating the configuration of the periphery of this collected toner conveying member.

FIG. 16 is an explanatory view illustrating the configuration of the periphery of a collected toner conveying member of a toner removing unit used in a fifth embodiment.

As shown in FIG. 16, the basic configuration of the toner removing unit of the fifth embodiment is substantially the same as that of the fourth embodiment. However, a collected toner conveying member 53 according to the fifth embodiment differs in configuration from that of the fourth embodiment.

According to the fifth embodiment, the collected toner conveying member 53 is configured so that flanges 132 and 133 having a predetermined configuration are provided at both end portions of the rotating shaft 131 for conveying the collected toner, respectively, and that a coil-like conveying member 134 having wire-like members formed around the rotating shaft is provided between the flanges 132 and 133. Incidentally, a support portion 58 is provided at one 132 of the flanges.

According to the fifth embodiment, both the trapping sheet 70 according to the first embodiment and the coil-like conveying member 134 itself are utilized as the trapping members. That is, because the coil-like conveying member 134 has the spiral coil member, foreign matters such as fibrous dusts are easily entwined with the coil-like conveying member 134.

Consequently, according to the fifth embodiment, foreign matters such as fibrous dusts are entwined with and are trapped by the trapping sheet 70 and the coil-like conveying member 134.

Incidentally, according to the present embodiment, a mode also using the trapping sheet 70 has been described. It is apparent that the apparatus may be modified so that only the collected toner conveying member 53 having the coil-like conveying member 134 also serves as the trapping member.

Sixth Embodiment

Figure 17A:
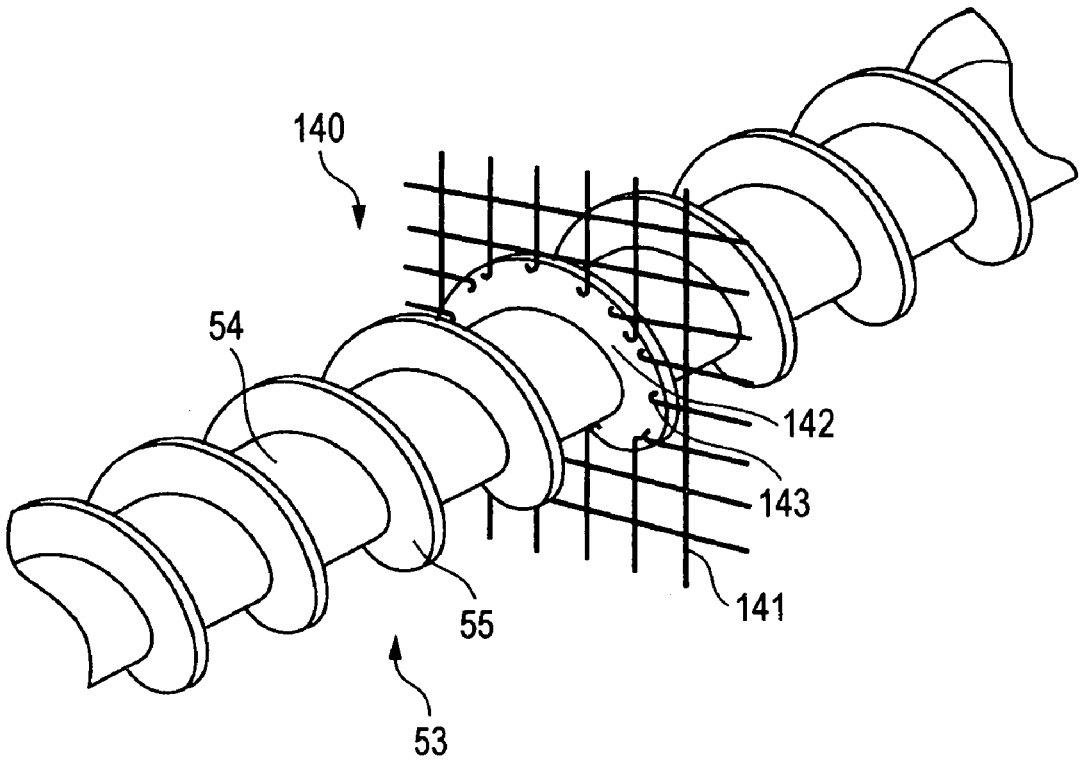
FIG. 17A is an explanatory view illustrating a collected toner conveying member of a toner removing unit used in a sixth embodiment and also illustrating the configuration of the periphery of this collected toner conveying member.
Figure 17B:
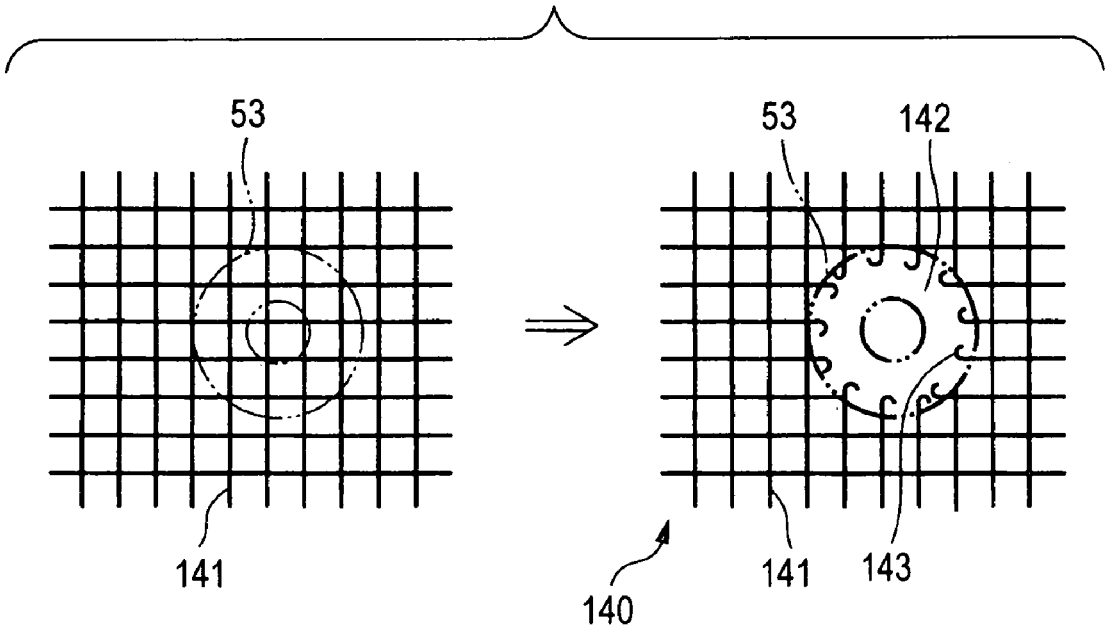
FIG. 17B is an explanatory view illustrating a manufacturing method for a trapping member shown in FIG. 17A.

FIG. 17 is an explanatory view illustrating the configuration of the periphery of a collected toner conveying member of a toner removing unit used in a sixth embodiment.

As shown in FIG. 17, the basic configuration of the toner removing unit of the sixth embodiment is substantially the same as that of the first embodiment. However, the sixth embodiment employs a trapping net 140 as the trapping member, which differs from that of the first embodiment.

According to the sixth embodiment, the trapping net 140 has a mesh member 141 formed by causing, for example, wire-like members to intersect with one another like a lattice. A through hole 142, through which the collected toner conveying member 53 passes, is formed in the mesh member 141. Also, hook-like parts 143 are formed at each end portion of the mesh member 141, which is located on an edge portion of the through hole 124. Incidentally, according to the sixth embodiment, the diameter of the through hole 142 is set to be slightly less than the outside diameter of the spiral blade 55 of the collected toner conveying member 53. The hook-like part 143 formed at each end portion of the mesh member 141 is contacted with the spiral blade 55 of the collected toner conveying member 53 to be able to be elastically deformable.

Consequently, according to the sixth embodiment, foreign matters such as fibrous dusts are entwined with and are trapped by the hook-like parts 143 of the trapping net 140.

Seventh Embodiment

Figure 18A:
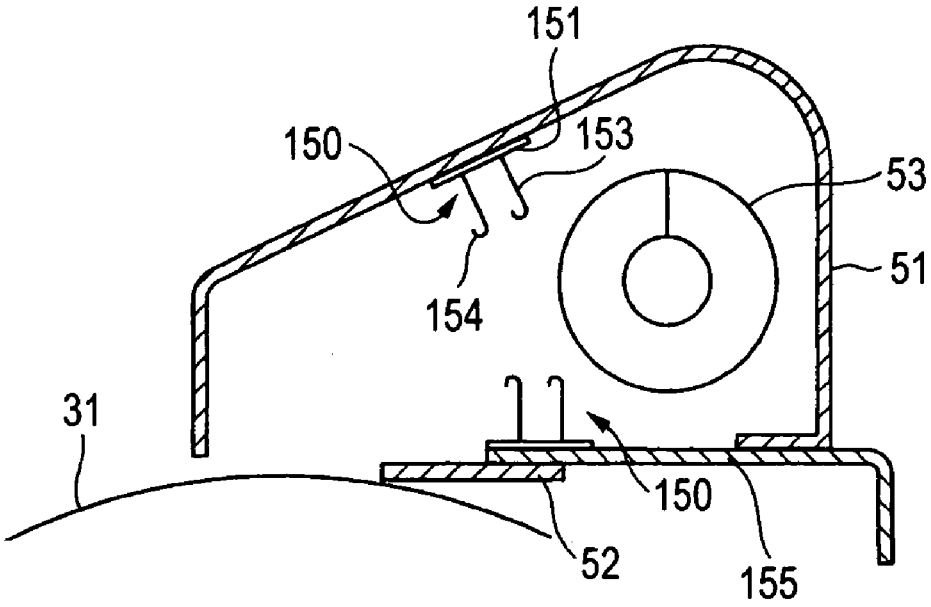
FIG. 18A is an explanatory view illustrating a collected toner conveying member of a toner removing unit used in a seventh embodiment and also illustrating the configuration of the periphery of this collected toner conveying member.

FIG. 18A is an explanatory view illustrating the configuration of the periphery of a collected toner conveying member of a toner removing unit used in a seventh embodiment.

As shown in FIG. 18A, the basic configuration of the toner removing unit 36 of the seventh embodiment is substantially the same as that of the first embodiment. However, the seventh embodiment employs a trapping mat 150 as the trapping member, which differs from that of the first embodiment.

According to the seventh embodiment, the trapping mat 150 is provided to extend along the longitudinal direction of an entrance-side wall surface (for example, a wall surface extending in an up-down direction) of the collected toner conveying member 53 in the case 51 of the toner removing unit 36, as shown in FIG. 18A. Although a blade 52 is attached to the case 51 through a bracket 155 in the seventh embodiment, the bracket 155 substantially constitutes a part of the case 51.

Figure 18B:
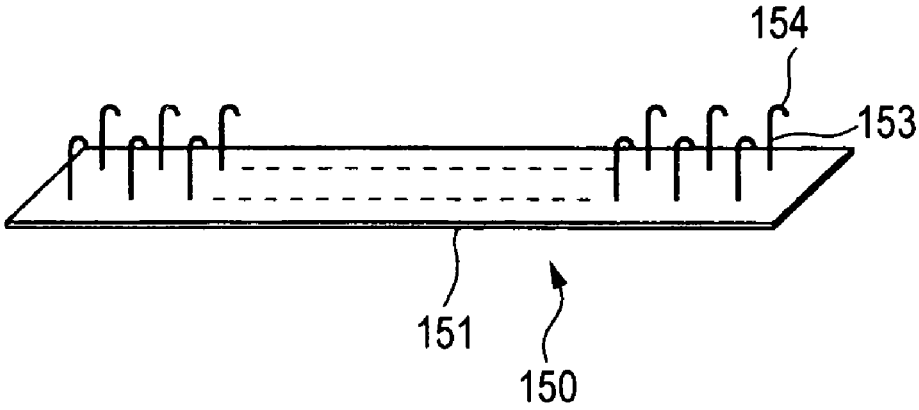
FIG. 18B is an explanatory view detailedly illustrating a trapping member shown in FIG. 18A.

Incidentally, as shown in FIG. 18B, the trapping mat 150 is formed by implanting or fixing hook wire-like members 153 such as a plurality of bristles of a brush, which are constituted by nylon fibers, polypropylene fibers, polyester fibers, animal fibers, or plant fibers, on or to a flexible fixing attachment piece 151 and additionally forming a hook-like part 154 at each of end portion of the hook wire-like members 153.

Accordingly, according to the present embodiment, when foreign matters such as fibrous dusts enter the case 51 from an opening thereof while residual toner is collected by the blade 52 of the toner removing unit 36, the foreign matters are trapped by the trapping mat 150 provided just posterior to the opening of the case 51.

Additionally, when the foreign matters such as fibrous dusts are floated while conveyed together with toner by the collected toner conveying member 53, the foreign matters are trapped by the trapping mat 150.

Although the trapping mat 150 is provided to continuously extend corresponding to the width of an opening of the case 51, the trapping member according to the invention is not limited thereto. The trapping mat 150 may be discontinuously provided.

Eighth Embodiment

Figure 19A:
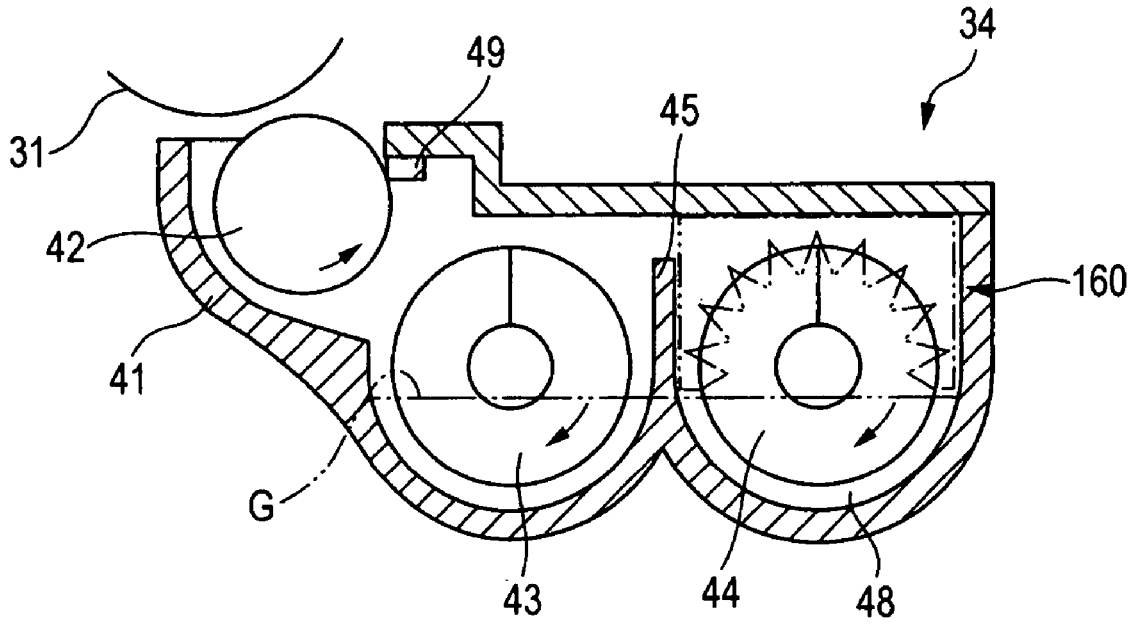
FIG. 19A is an explanatory view illustrating a primary part of the configuration of a developing unit used in an eighth embodiment.

FIG. 19A is an explanatory view illustrating the configuration of a developing unit used in an eighth embodiment.

As shown in FIG. 19A, the basic configuration of the developing unit 34 of the eighth embodiment is substantially the same as that of the first embodiment. However, the eighth embodiment differs from the first embodiment in that a trapping sheet 160 is provided as the trapping member in the developing unit 34. Incidentally, constituting elements similar to those of the first embodiment are designated by similar reference numerals used in the description of the first embodiment. Thus, the detailed description of such constituent elements is omitted herein.

Figure 19B:
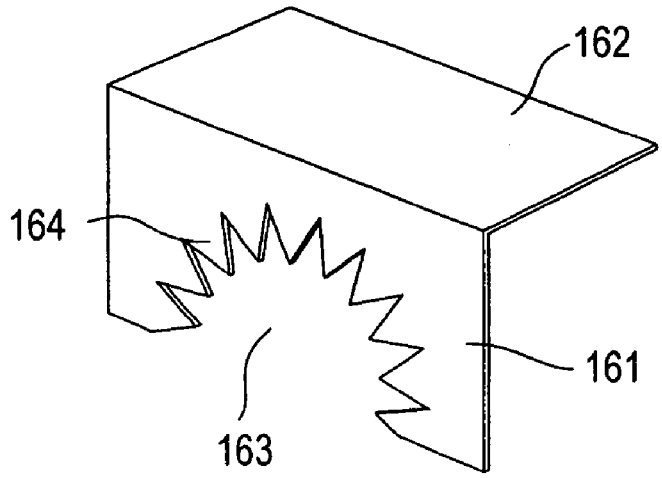
FIG. 19B is an explanatory view detailedly illustrating a trapping member used in the developing unit shown in FIG. 19A.

As shown in FIG. 19B, the trapping sheet 160 has a sheet substrate 161 made of a flexible or elastic material, for example, polyimide. A fixing attachment piece 162 such as a double-sided tape is provided at one end of the sheet substrate 161. On the other hand, a substantially semicircular opening 163, through which the collected toner conveying member 53 can pass, is opened in the sheet substrate 161. A plurality of sharp-tipped projection portions 164, for example, triangular projection portions 164 are formed along the opening edge of the opening 163.

According to the eighth embodiment, the trapping sheet 160 is configured so that the fixing attachment piece 161 of the trapping sheet 160 is fixed to an upper wall inner surface of a developer accommodating container 41 of a developer circulation path 48 at the side at which, for example, one 44 of agitation conveying members of the developing unit 34, and that the trapping sheet 160 is suspended therefrom. Incidentally, because the circulation conveyance of a predetermined amount of the developer G is performed in a developer circulation path 48 shown in FIG. 19B, it is advisable to dispose the trapping sheet 160 in an upper space which is filled with at least the developer.

At that time, the agitation conveying member 44 passes through the opening 163 of the trapping sheet 160 and conveys the developer including the toner and the carrier while causing a trapping portion 164 to elastically deform. In such an operation process, it is frequent that foreign matters such as fibrous dusts move in a state in which the foreign matters are floated above the developer, and that the foreign matters are dammed and are trapped by the trapping sheet 160.

Also, in a case where the eighth embodiment is modified so that, for example, the developer accommodating container 41 is divided into upper and lower housings, when the upper housing of the developer accommodating container 41 is removed, foreign matters trapped by the trapping sheet 160 can be cleaned. Additionally, the eight embodiment may be modified so that, for example, when the developer in the developing unit 34 is replaced, the upper housing of the developer accommodating container 41 is removed, and that simultaneously with replacement of the developer, the trapping sheet 160 provided in the housing is replaced with new one.

Ninth Embodiment

Figure 20A:
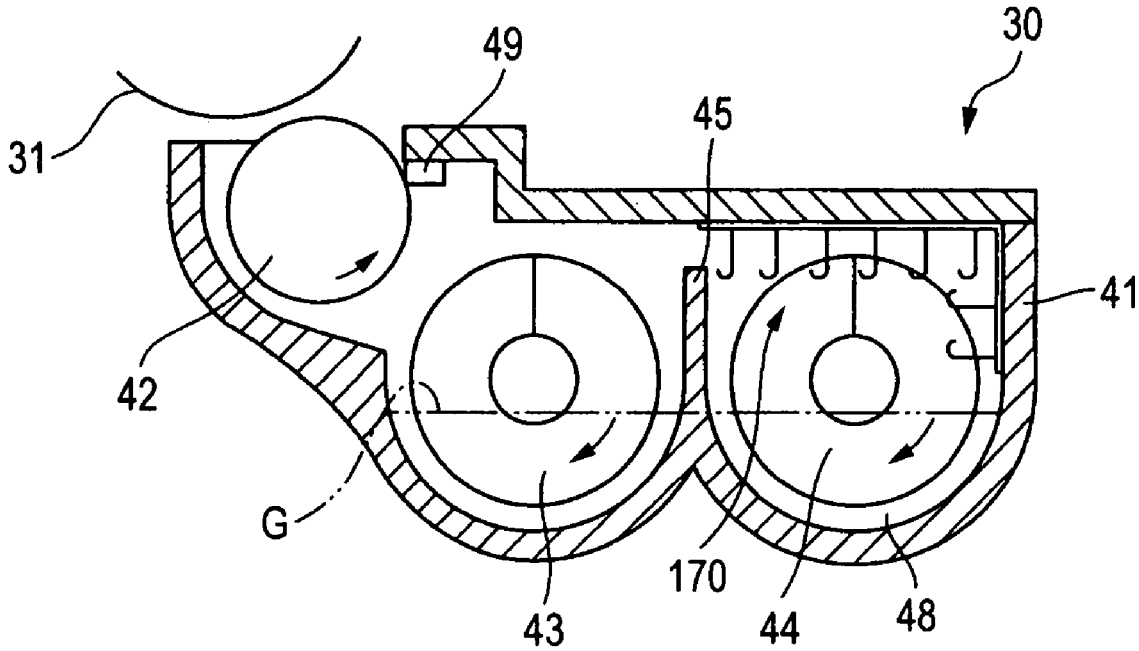
FIG. 20A is an explanatory view illustrating a primary part of the configuration of a developing unit used in a ninth embodiment.

FIG. 20A is an explanatory view illustrating the configuration of a developing unit used in a ninth embodiment.

As shown in FIG. 20A, the basic configuration of the developing unit 34 of the ninth embodiment is substantially the same as that of the eighth embodiment. However, the ninth embodiment differs from the eighth embodiment in that a trapping sheet 170 is provided as the trapping member in the developing unit 34. Incidentally, constituting elements similar to those of the eighth embodiment are designated by similar reference numerals used in the description of the eighth embodiment. Thus, the detailed description of such constituent elements is omitted herein.

Figure 20B:
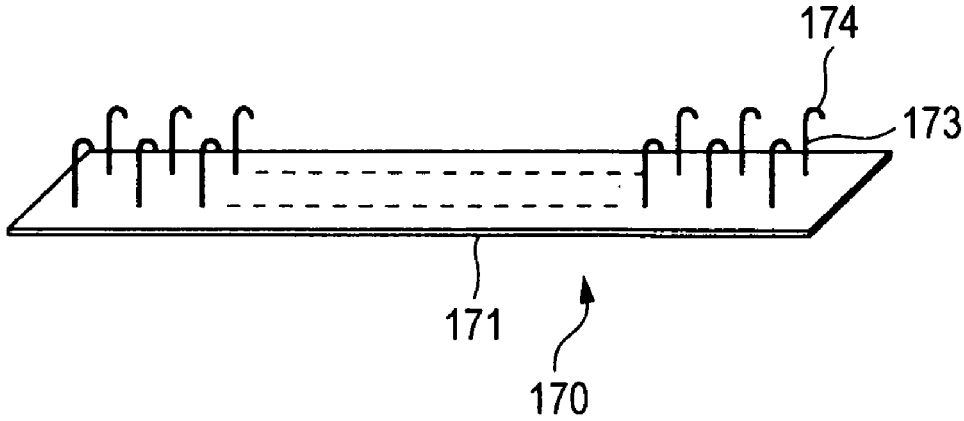
FIG. 20B is an explanatory view detailedly illustrating a trapping member used in the developing unit shown in FIG. 20A.

As shown in FIG. 20B, the trapping mat 170 is formed by implanting or fixing hook wire-like members 173 such as a plurality of bristles of a brush, which are constituted by nylon fibers, polypropylene fibers, polyester fibers, animal fibers, or plant fibers, on or to a flexible fixing attachment piece 171 and additionally forming a hook-like part 174 at each of end portion of the hook wire-like members 173.

According to the ninth embodiment, the trapping sheet 170 is configured so that the fixing attachment piece 171 of the trapping sheet 170 is fixed to an upper wall inner surface of a developer accommodating container 41 of a developer circulation path 48 at the side at which, for example, one 44 of agitation conveying members of the developing unit 34, and that the hook wire-like members 173 are disposed on the inner wall surface of the developer accommodating container 41 to protrude therefrom.

Although an amount of projection of each of the hook wire-like members 173 can be set so that the hook wire-like members 173 are contacted with the developer G in the developer circulation path 48, preferably, to trap the floated foreign matters such as fibrous dusts, the hook wire-like members 173 are disposed so as not to be contacted with the developer G.

Accordingly, according to the ninth embodiment, the agitation conveying member 44 conveys the developer (including toner and carrier) in the developer circulation path 48. In such an operation process, it is frequent that foreign matters such as fibrous dusts move in a state in which the foreign matters are floated above the developer, and that the foreign matters are dammed and are trapped by the hook wire-like members 173 of the trapping mat 170.

Substantially similarly to the eighth embodiment, in the case of the ninth embodiment, the cleaning and the replacement of the trapping mat 170 can easily be performed, for example, by removing the upper housing of the developer accommodating container 41 of the type that is divided into upper and lower housings.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming member comprising:

an electrostatic latent image holding member that holds an electrostatic latent image;

a developing unit that develops a toner image formed by a toner on a surface of the electrostatic latent image holding member;

a toner removing member that removes a residual toner remaining on a surface of the electrostatic latent image holding member;

a conveying path including a conveying member that is internally provided in the conveying path and that returns the residual toner removed from the surface of the electrostatic latent image holding member to the developing unit; and a trapping portion that traps a foreign matter conveyed by the conveying member, the electrostatic latent image holding member, the developing unit, the toner removing member, the conveying path, and the trapping portion of the image forming member being integrally and detachably attached to an image forming apparatus body, wherein the trapping portion includes a through hole through which the conveying member passes, and a plurality of sharp-tipped projection portions formed along the through hole.

2. The image forming member as claimed in claim 1, wherein the trapping portion traps the foreign matter conveyed by the conveying member between an inner wall surface of the conveying path and the conveying member.

3. The image forming member as claimed in claim 1, wherein the trapping portion extends from an inner wall surface of the conveying path to the conveying member.

4. The image forming member as claimed in claim 1, wherein the trapping portion is provided on the conveying member.

5. The image forming member as claimed in claim 1, which comprises a toner removing unit including: the toner removing member; and a part of the conveying path, the trapping portion being disposed in the toner removing unit.

6. A toner removing apparatus comprising:

a toner removing member that removes a residual toner remaining on a surface of the electrostatic latent image holding member;

a conveying path having a conveying member that is internally provided in the conveying path and that returns the residual toner removed from the surface of the electrostatic latent image holding member; and a trapping portion that is provided on the conveying member and that traps a foreign matter conveyed by the conveying member, wherein the trapping portion includes a through hole through which the conveying member passes, and a plurality of sharp-tipped projection portions formed along the through hole.

7. An image forming apparatus having an image forming member, the image forming member comprising:

an electrostatic latent image holding member that holds an electrostatic latent image;

a developing unit that develops a toner image formed by a toner on a surface of the electrostatic latent image holding member;

a toner removing member that removes a residual toner remaining on a surface of the electrostatic latent image holding member;

a conveying path including a conveying member that is internally provided in the conveying path and that returns the residual toner removed from the surface of the electrostatic latent image holding member to the developing unit; and a trapping portion that traps a foreign matter conveyed by the conveying member, the electrostatic latent image holding member, the developing unit, the toner removing member, the conveying path, and the trapping portion of the image forming member being integrally and detachably attached to an image forming apparatus body, wherein the image forming member is detachable from an image forming apparatus body, and wherein the trapping portion includes a through hole through which the conveying member passes, and a plurality of sharp-tipped projection portions formed along the through hole.

8. An image forming apparatus having a toner removing apparatus, the toner removing apparatus comprising:

a toner removing member that removes a residual toner remaining on a surface of the electrostatic latent image holding member;

a conveying path having a conveying member that is internally provided in the conveying path and that returns the residual toner removed from the surface of the electrostatic latent image holding member; and a trapping portion that is provided on the conveying member and that traps a foreign matter conveyed by the conveying member, wherein the trapping portion includes a through hole through which the conveying member passes, and a plurality of sharp-tipped projection portions formed along the through hole, and, wherein the toner removing apparatus is detachable.

* * * * *